United States Patent [19]

Rucktenwald et al.

[11] 4,311,076

[45] Jan. 19, 1982

[54] ELECTRONIC MUSICAL INSTRUMENT WITH HARMONY GENERATION

[75] Inventors: Thomas E. Rucktenwald, Schaumburg; William E. Braun, Jr., Chicago; Louis S. Lazare; Sharming Lin, both of Skokie; Byron Melcher, Arlington Heights, all of Ill.

[73] Assignee: Whirlpool Corporation, Benton Harbor, Mich.

[21] Appl. No.: 110,384

[22] Filed: Jan. 7, 1980

[51] Int. Cl.[3] ..... G10H 1/22; G10H 1/40

[52] U.S. Cl. ..... 84/1.03; 84/1.17; 84/DIG. 2; 84/DIG. 22

[58] Field of Search ..... 84/1.01, 1.03, 1.17, 84/1.24, DIG. 2, DIG. 12, DIG. 22

[56] References Cited

U.S. PATENT DOCUMENTS

| | | | |
|---|---|---|---|
| 3,694,562 | 9/1972 | Hiyma | 84/1.24 X |
| 3,711,618 | 1/1973 | Freeman | 84/1.03 |
| 3,745,225 | 7/1973 | Hall | 84/1.03 |
| 3,823,246 | 7/1974 | Hebeisen et al. | 84/1.17 |
| 3,929,051 | 12/1975 | Moore | 84/1.17 |
| 3,990,339 | 11/1976 | Robinson et al. | 84/1.17 |
| 4,031,786 | 6/1977 | Kaplan | 84/1.03 |
| 4,046,047 | 9/1977 | Roberts | 84/1.01 |
| 4,148,241 | 4/1979 | Morez et al. | 84/1.03 |
| 4,197,777 | 4/1980 | Wheelwright et al. | 84/1.03 |

*Primary Examiner*—Stanley J. Witkowski

*Attorney, Agent, or Firm*—Wegner, Stellman, McCord, Wood & Dalton

[57] ABSTRACT

An electronic organ includes a plurality of buffers for receiving solo keyswitch status information, accompaniment keyswitch status without octave information, and depressed keyswitch status from an arpeggio keyboard. A scan circuit and a microprocessor gate the buffers into an input memory which retains an image of the solo, accompaniment, and arpeggio keyboards. A control program, stored in ROM, is responsive to the input memory, shared registers, and harmony switches actuable in several modes, to produce one or plural harmony notes in either open or closed harmony, and to assign different note names to the actuated keyswitches on the arpeggio keyboard. The resulting harmony and arpeggio notes are stored in an output memory and are transferred to a transistor matrix which activates solo keyers to produce harmony and arpeggio notes with solo voicing. A rhythmic harmony modulator is actuable to modulate the harmony notes in a rhythmic pattern of individual and delayed beats.

55 Claims, 29 Drawing Figures

MICRO-PROCESSOR 54
EN Ø
171
+5V
152
154
156
158
160
-17V

MICRO-PROCESSOR 54
84
180
182
184
186
188
190
192
194
196
198
200
+10
+5
DATA
CLOCK
LATCH
S/P 86
88
72
HARMONY SWITCHES
FEATURES MODULE
94
ROM 62
ADDRESS LATCH 64
BUS DRIVER 52

TO DATA BUS 50
Ø
1
2
3
161
162
164
166
168
170
172
BASIC HARMONY
THEATRE HARMONY
HARMONY DUET
COUNTER MELODY
90
91
204
206
208
218
220
FIG. 6 92, 96
KEYBOARD SCAN 40
26
SOLO VOLUME CONTROL
SOLO KEYERS 24
SOLO KEYBOARD 20

Fig. 9.

A

| BIT | ACCP | ACCP | SOLO | SOLO | SOLO | SOLO | SOLO | SOLO | ARP | ARP | ENØ |
|---|---|---|---|---|---|---|---|---|---|---|---|
| Ø | C | $F^{\#}$ | | $C_6$ | $F^{\#}_5$ | $C_5$ | $F^{\#}_4$ | $C_4$ | | | BASIC HARMONY TAB |
| 1 | B | F | | $B_5$ | $F_5$ | $B_4$ | $F_4$ | $B_3$ | | | THEATRE HARMONY TAB |
| 2 | $A^{\#}$ | E | 330 | $A^{\#}_5$ | $E_5$ | $A^{\#}_4$ | E | $A^{\#}_3$ | | | HARMONY DUET TAB |
| 3 | A | $D^{\#}$ | C7 THRU $D^{\#}6$ | $A_5$ | $D^{\#}_5$ | $A_4$ | $D^{\#}_4$ | $A_3$ | | | COUNTER MELODY TAB |
| 4 | $G^{\#}$ | D | $D_6$ | $G^{\#}_5$ | $D_5$ | $G^{\#}_4$ | $D_4$ | $G^{\#}_3$ | | | MEMORY ON/OFF |
| 5 | G | $C^{\#}$ | $C^{\#}_6$ | $G_5$ | $C^{\#}_5$ | $G_4$ | $C^{\#}_4$ | $G_3$ | | | 7TH |
| 6 | | | | | | | | | | | SINGLE FINGER CHORD |
| 7 | | | | | | | | | | | MINOR |

B

| DECODER COUNT | Ø | 1 | 2 | 3 | 4 | 5 | 6 | 7 | 8 | 9 |
|---|---|---|---|---|---|---|---|---|---|---|

Fig. 10.

| | | | | | | | | | | |
|---|---|---|---|---|---|---|---|---|---|---|
| Ø | | | | $C_6$ | $F^{\#}_5$ | $C_5$ | $F^{\#}_4$ | $C_4$ | $F_3$ | | |
| 1 | | | | $B_5$ | $F_5$ | $B_4$ | $F_4$ | $B_3$ | $F_2$ | | |
| 2 | | | | $A^{\#}_5$ | $E_5$ | $A^{\#}_4$ | $E_4$ | $A^{\#}_3$ | $E_3$ | | |
| 3 | | | | $A_5$ | $D^{\#}_5$ | $A_4$ | $D^{\#}_4$ | $A_3$ | | | |
| 4 | | | | $G^{\#}_5$ | $D_5$ | $G^{\#}_4$ | $D_4$ | $G^{\#}_3$ | | | |
| 5 | | | | $G_5$ | $C^{\#}_5$ | $G_4$ | $C^{\#}_4$ | $G_3$ | | | |
| 6 | | | | | | | | | | | |
| 7 | | | | | | | | | | | |

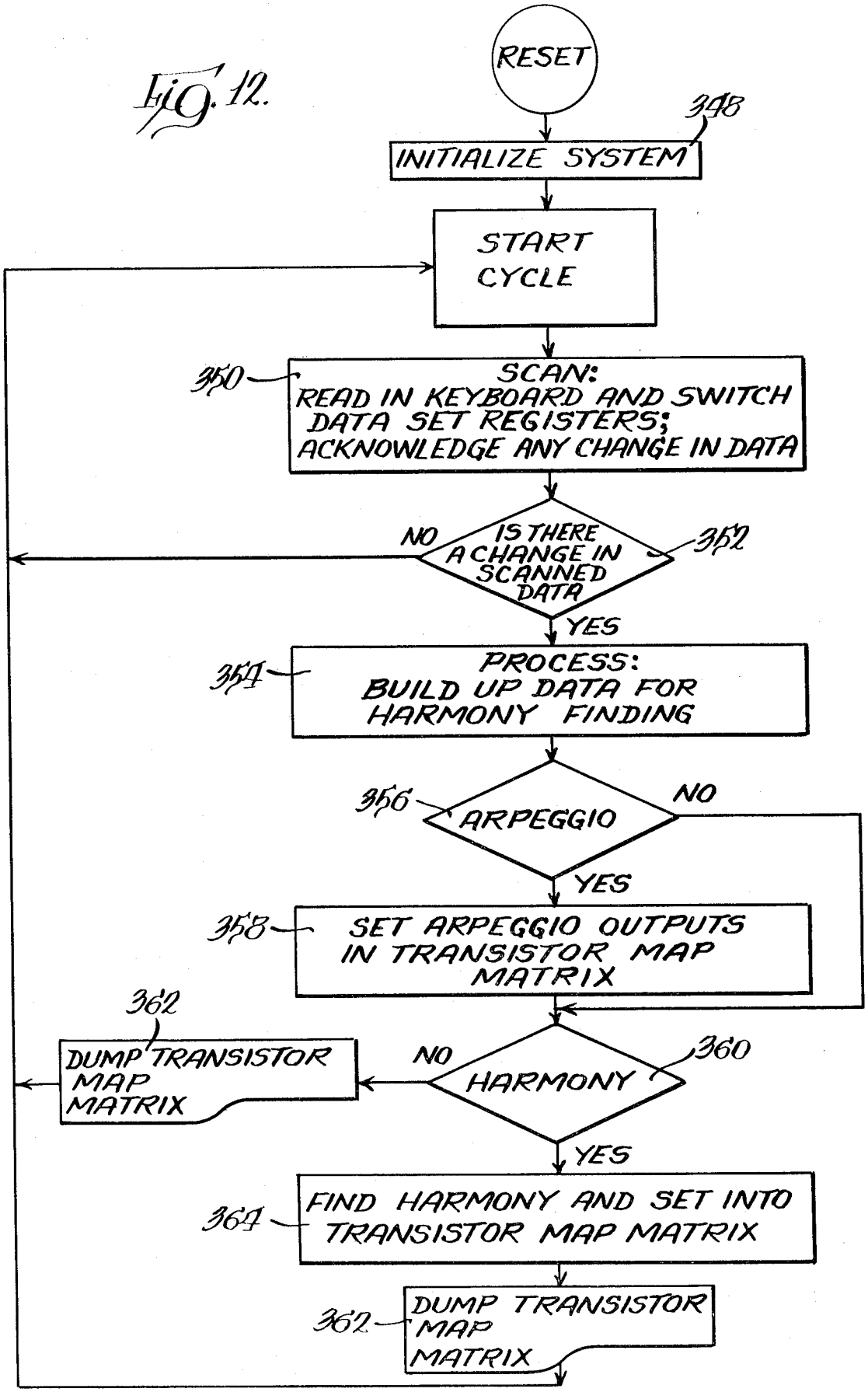
Fig. 12.
RESET
348
INITIALIZE SYSTEM
START CYCLE
350
SCAN:
READ IN KEYBOARD AND SWITCH DATA SET REGISTERS;
ACKNOWLEDGE ANY CHANGE IN DATA
NO
IS THERE A CHANGE IN SCANNED DATA
352
YES
354
PROCESS:
BUILD UP DATA FOR HARMONY FINDING
356
ARPEGGIO
NO
YES
358
SET ARPEGGIO OUTPUTS IN TRANSISTOR MAP MATRIX
362
DUMP TRANSISTOR MAP MATRIX
NO
HARMONY
360
YES
364
FIND HARMONY AND SET INTO TRANSISTOR MAP MATRIX
362
DUMP TRANSISTOR MAP MATRIX

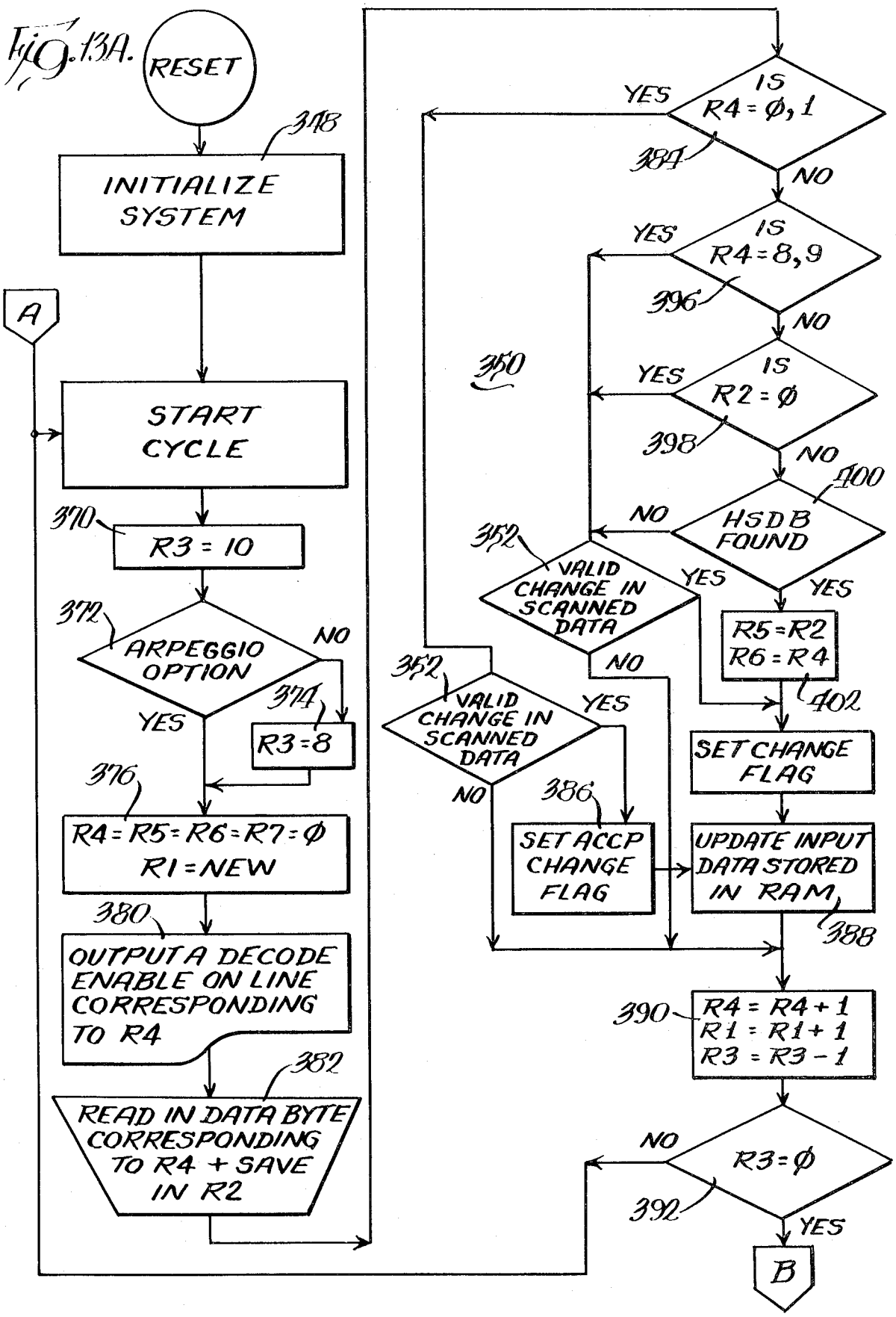
Fig. 13A.
RESET
348
INITIALIZE SYSTEM
A
START CYCLE
370
R3 = 10
372
ARPEGGIO OPTION
NO
YES
374
R3 = 8
376
R4 = R5 = R6 = R7 = Ø
R1 = NEW
380
OUTPUT A DECODE ENABLE ON LINE CORRESPONDING TO R4
382
READ IN DATA BYTE CORRESPONDING TO R4 + SAVE IN R2
350
IS R4 = Ø, 1
YES
384
NO
IS R4 = 8, 9
YES
396
NO
IS R2 = Ø
YES
398
NO
400
HSDB FOUND
NO
YES
YES
352
VALID CHANGE IN SCANNED DATA
YES
NO
R5 = R2
R6 = R4
402
352
VALID CHANGE IN SCANNED DATA
YES
NO
386
SET ACCP CHANGE FLAG
SET CHANGE FLAG
UPDATE INPUT DATA STORED IN RAM
388
390
R4 = R4 + 1
R1 = R1 + 1
R3 = R3 - 1
NO
R3 = Ø
392
YES
B

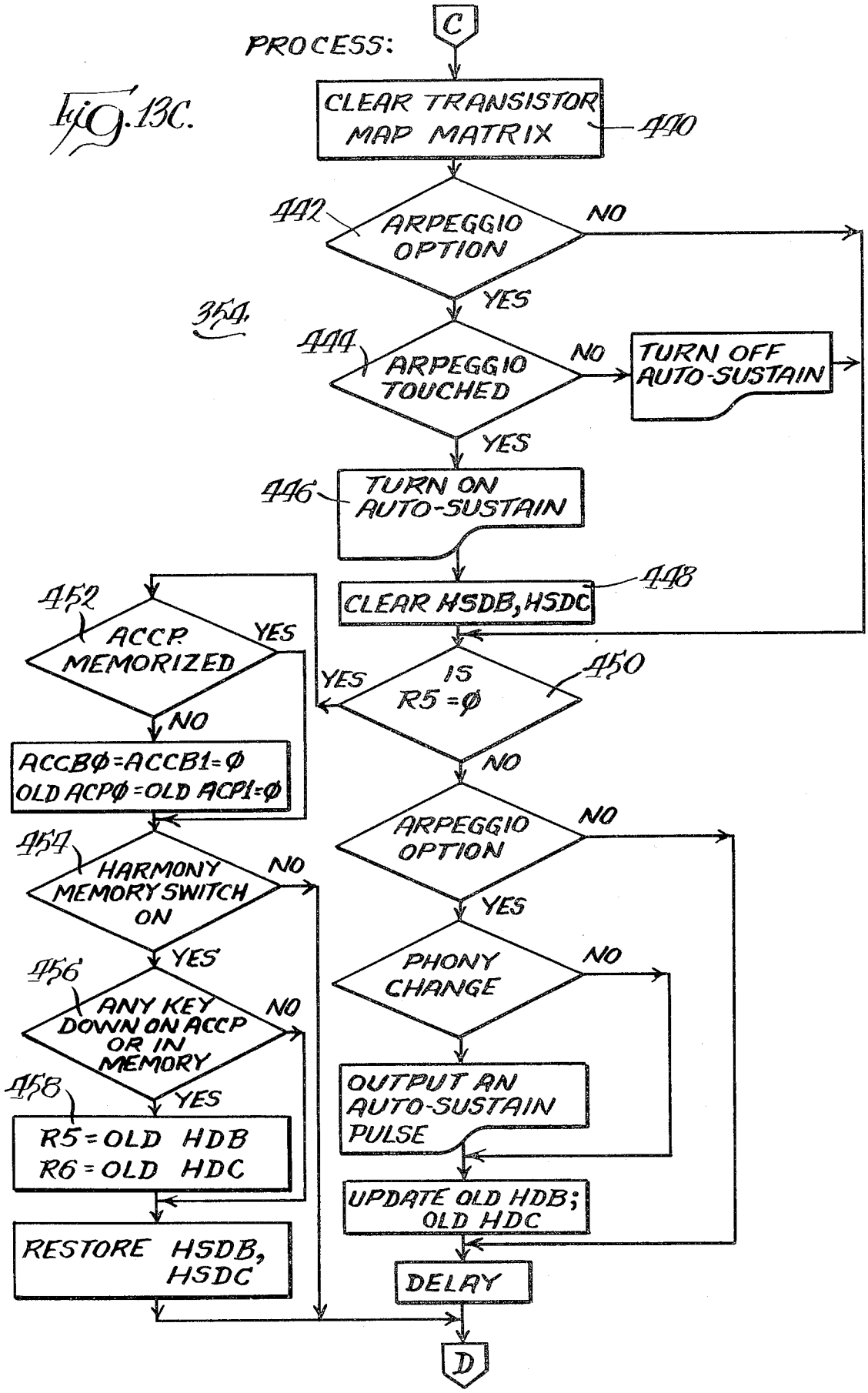
PROCESS:
C
Fig. 13C.
CLEAR TRANSISTOR MAP MATRIX
440
442
ARPEGGIO OPTION
NO
YES
354
444
ARPEGGIO TOUCHED
NO
TURN OFF AUTO-SUSTAIN
YES
446
TURN ON AUTO-SUSTAIN
CLEAR HSDB, HSDC
448
452
ACCP MEMORIZED
YES
NO
YES
IS R5 = Ø
450
NO
ACCBØ = ACCB1 = Ø
OLD ACPØ = OLD ACP1 = Ø
454
HARMONY MEMORY SWITCH ON
NO
YES
456
ANY KEY DOWN ON ACCP OR IN MEMORY
NO
YES
458
R5 = OLD HDB
R6 = OLD HDC
RESTORE HSDB, HSDC
ARPEGGIO OPTION
NO
YES
PHONY CHANGE
NO
OUTPUT AN AUTO-SUSTAIN PULSE
UPDATE OLD HDB; OLD HDC
DELAY
D

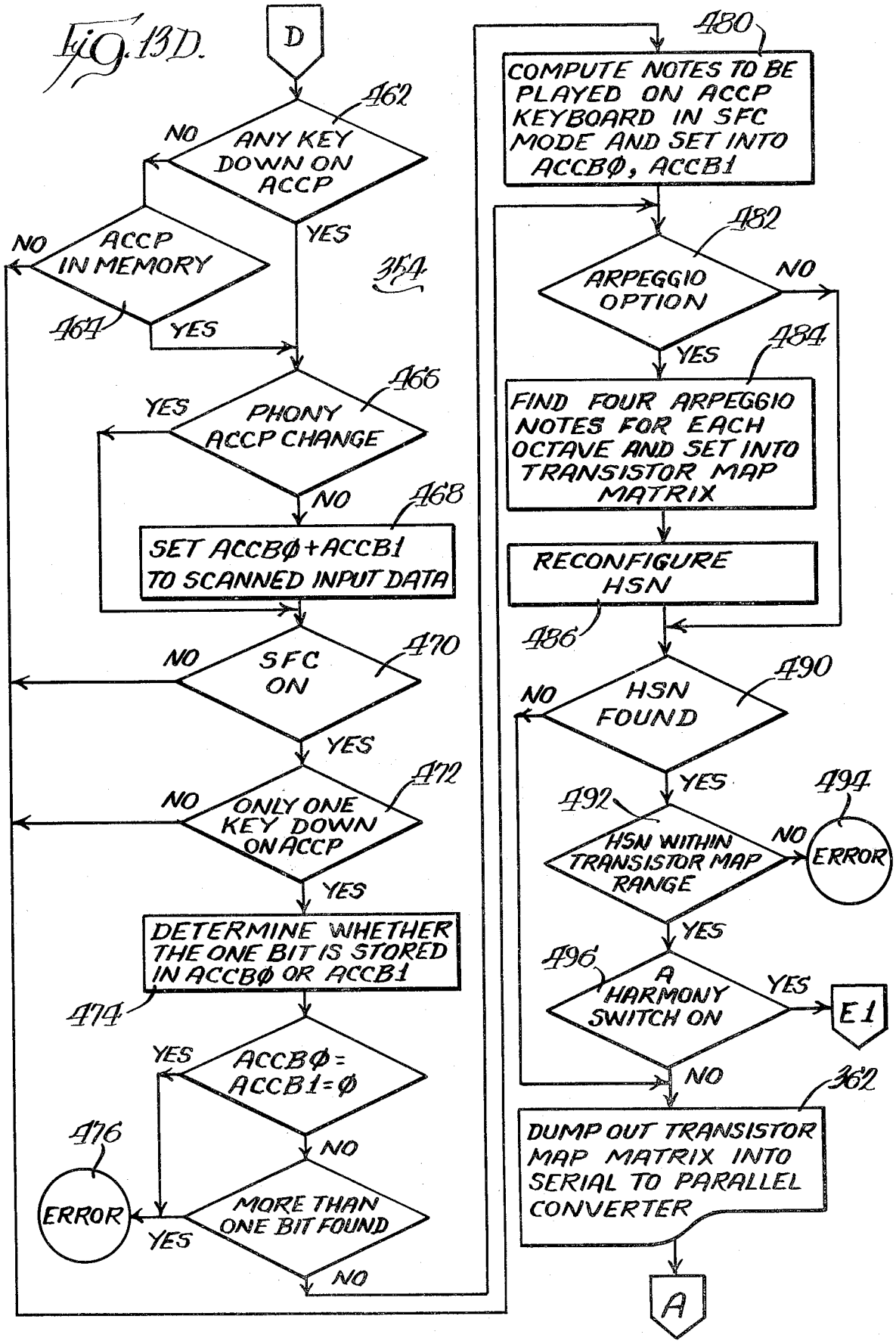
Fig. 13D.
D
462
ANY KEY DOWN ON ACCP
NO
YES
ACCP IN MEMORY
NO
YES
464
354
466
PHONY ACCP CHANGE
YES
NO
468
SET ACCBØ+ACCB1 TO SCANNED INPUT DATA
470
SFC ON
NO
YES
472
ONLY ONE KEY DOWN ON ACCP
NO
YES
DETERMINE WHETHER THE ONE BIT IS STORED IN ACCBØ OR ACCB1
474
ACCBØ= ACCB1=Ø
YES
NO
476
ERROR
MORE THAN ONE BIT FOUND
YES
NO
480
COMPUTE NOTES TO BE PLAYED ON ACCP KEYBOARD IN SFC MODE AND SET INTO ACCBØ, ACCB1
482
ARPEGGIO OPTION
NO
YES
484
FIND FOUR ARPEGGIO NOTES FOR EACH OCTAVE AND SET INTO TRANSISTOR MAP MATRIX
RECONFIGURE HSN
486
490
HSN FOUND
NO
YES
492
HSN WITHIN TRANSISTOR MAP RANGE
NO
494
ERROR
YES
496
A HARMONY SWITCH ON
YES
E1
NO
362
DUMP OUT TRANSISTOR MAP MATRIX INTO SERIAL TO PARALLEL CONVERTER
A

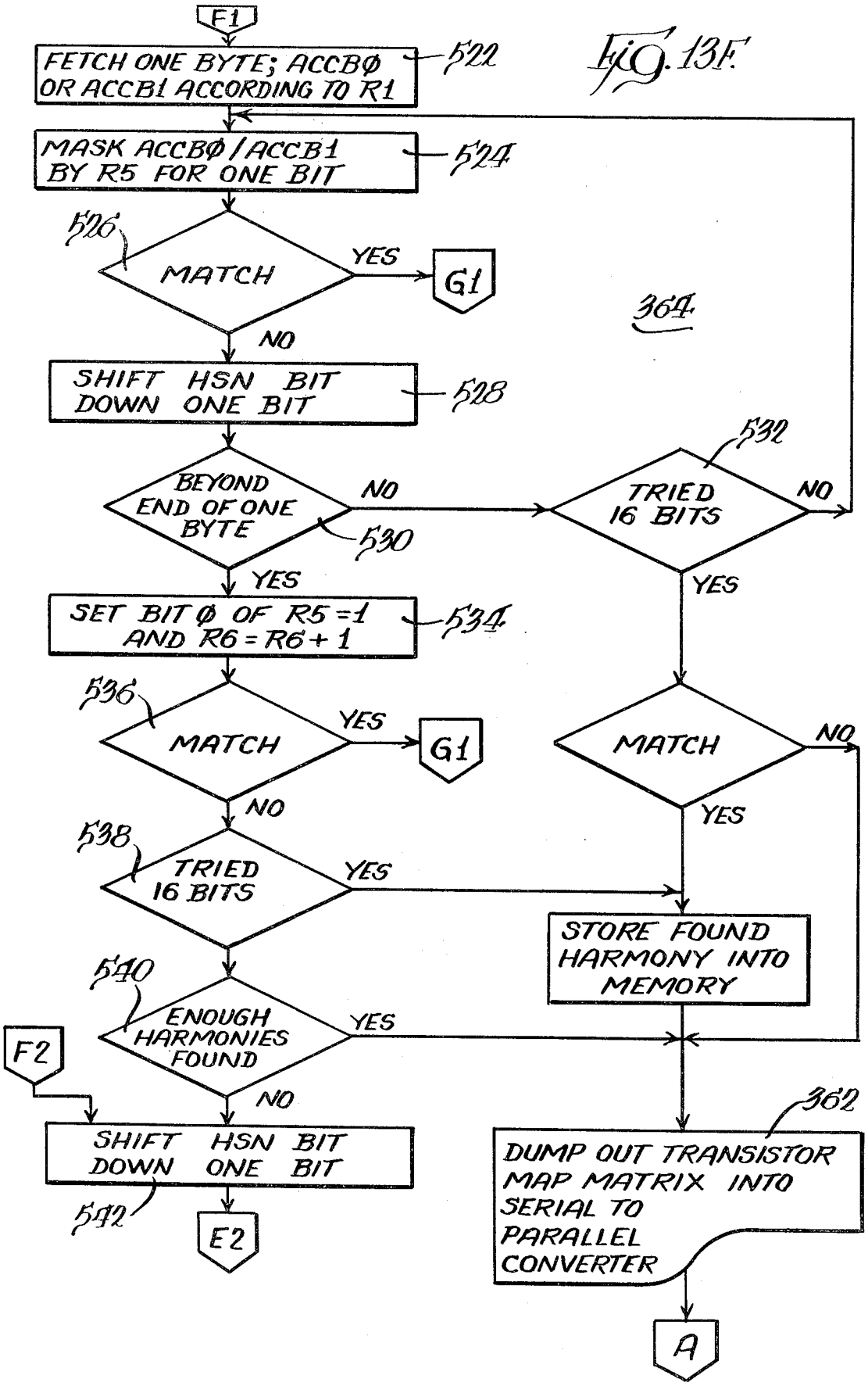
F1
FETCH ONE BYTE; ACCBØ OR ACCB1 ACCORDING TO R1
522
FIG. 13F.
MASK ACCBØ/ACCB1 BY R5 FOR ONE BIT
524
526
MATCH
YES
G1
364
NO
SHIFT HSN BIT DOWN ONE BIT
528
532
BEYOND END OF ONE BYTE
NO
TRIED 16 BITS
NO
530
YES
YES
SET BIT Ø OF R5 = 1 AND R6 = R6 + 1
534
536
MATCH
YES
G1
MATCH
NO
NO
YES
538
TRIED 16 BITS
YES
STORE FOUND HARMONY INTO MEMORY
540
ENOUGH HARMONIES FOUND
YES
F2
NO
362
SHIFT HSN BIT DOWN ONE BIT
542
E2
DUMP OUT TRANSISTOR MAP MATRIX INTO SERIAL TO PARALLEL CONVERTER
A

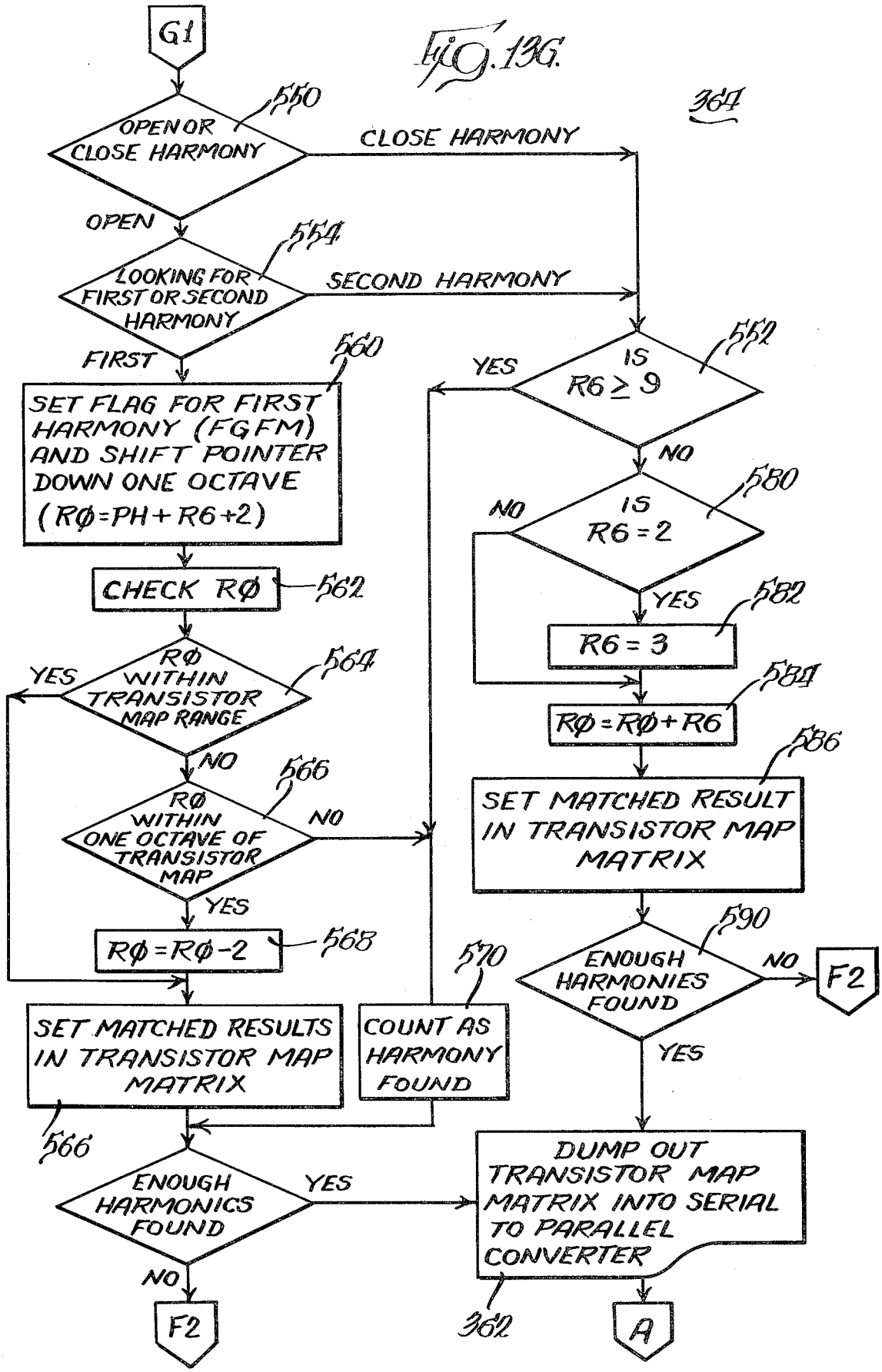
G1
Fig. 13G.
364
550
OPEN OR CLOSE HARMONY
CLOSE HARMONY
OPEN
554
LOOKING FOR FIRST OR SECOND HARMONY
SECOND HARMONY
FIRST
560
SET FLAG FOR FIRST HARMONY (FGFM) AND SHIFT POINTER DOWN ONE OCTAVE (RØ=PH+R6+2)
CHECK RØ
562
RØ WITHIN TRANSISTOR MAP RANGE
564
YES
NO
566
RØ WITHIN ONE OCTAVE OF TRANSISTOR MAP
NO
YES
RØ=RØ-2
568
SET MATCHED RESULTS IN TRANSISTOR MAP MATRIX
566
ENOUGH HARMONICS FOUND
YES
NO
F2
570
COUNT AS HARMONY FOUND
552
IS R6 ≥ 9
YES
NO
580
IS R6 = 2
NO
YES
582
R6 = 3
584
RØ=RØ+R6
586
SET MATCHED RESULT IN TRANSISTOR MAP MATRIX
590
ENOUGH HARMONIES FOUND
NO
F2
YES
DUMP OUT TRANSISTOR MAP MATRIX INTO SERIAL TO PARALLEL CONVERTER
362
A

ELECTRONIC MUSICAL INSTRUMENT WITH HARMONY GENERATION

BACKGROUND OF THE INVENTION

This invention related to an electronic musical instrument having a control for automatically generating notes in predetermined relationships to notes selected by an organist.

Electronic organs have been known in which accompaniment notes played are transposed to the octave below the highest solo note in order to simulate harmony notes. Early attempts to implement such a feature have interconnected large numbers of switches activated by the solo and accompaniment keyboards in order to automatically provide a simple harmony in which the harmony notes are a function of the solo notes and accompaniment notes played. As digital techniques came into use, electronic harmony generators were developed to replace the complex interconnected switching networks. For example, a pulse train of time-encoded notes has been passed through a window so as to create harmony notes having the same note names as the actuated accompaniment notes. In other circuits, the accompaniment notes have been encoded, using a read only memory or ROM, into binary representations which then control a similar window for passing time-encoded notes representing note frequencies.

Some attempts have been made to produce harmony effects other than "closed harmony" in which the accompaniment notes are transposed to the octave below the highest solo note. For example, prewired circuits have passed accompaniment notes in the second octave below the highest solo note in an attempt to create "open harmony". However, the effect is not musically pleasing in that all of the notes are sounded in only one octave location.

Arpeggio generation is another type of automatic control for generating notes, which sound in the solo voice, in accordance with note names selected by an organist on an accompaniment keyboard. To allow a semi-automatic operation, it has been known to provide a shortened arpeggio keyboard which has been prewired to represent groups of notes so that, as an organist moves his finger across the keyboard, the same note names as actuated on the accompaniment keyboard will be sounded through several octaves. However, such arrangements limit the notes which can be played and sometimes create undesirable time gaps between notes so that a pleasing arpeggio effect is not produced.

Automatic note generators have included a fold back circuit in order to fold back all notes which fall outside the range of the organ, such as may occur when notes are automatically transposed. However, such a fold back of all notes creates a predictable response, and may produce notes in discord with other notes played by the organist.

Automatic note generators of the above type have involved digital integrated circuits which generally rely on time domain multiplexing in which each key is represented by an individual pulse within a string of pulse locations representing all octaves of the organ. Such an arrangement makes it difficult to manipulate notes in complex ways so as to produce a variety of musical effects.

SUMMARY OF THE INVENTION

In accordance with the present invention, the disadvantages of prior electronic organs with various types of automatic note generators such as discussed above have been overcome. In response to notes which an organist selects on the solo and accompaniment keyboards, a variety of new notes are produced which are selectable in number, octave location, spacing, and the like so as to more closely simulate the effects of a skilled organist.

A unique harmony generator includes harmony switches for selecting a plurality of harmony modes which will produce single and plural notes in true open or closed harmony. In addition to basic harmony in which harmony notes having the same note names as accompaniment notes played are produced in the first octave below the highest solo note, the generator can produce theater harmony, harmony duet, counter melody and other effects. In theater harmony, the first harmony note below the highest solo note is transposed down to the second octave while the second harmony note remains in the first octave below the highest solo note to create a true "open harmony" effect. As used herein, the phrase first octave or adjacent octave below the highest solo note refers to the first twelve notes falling below the highest solo note played by the organist on the solo manual. In harmony duet and counter melody, only one harmony note results even though several notes are selected on the accompaniment keyboard. This single harmony note can be sounded in the octave immediately adjacent, or in the next octave, from the highest solo note so as to create additional closed and open harmony effects. A harmony memory allows continuation of harmony effects after the accompaniment keyboard ceases to be actuated by the organist.

The harmony notes are prevented from being generated within a minor third from the highest solo note in order to prevent discord. When a harmony note falls outside the range of the organ, it is automatically folded back into a different octave provided it does not exceed a predetermined range. When discord would result, harmony notes are discarded without sounding other note names as replacement harmony notes. Other logical rules are followed to insure the integrity of the automatically generated harmony notes.

An arpeggio generator, in response to actuated notes on the accompaniment keyboard, reassigns the same note names, in groups of different octaves, to individual keyswitches on an arpeggio keyboard. Certain keyswitches are unassigned so that a musically pleasing arpeggio effect is created as an organist runs his finger over the arpeggio keyboard.

A microprocessor controls the operation of a random access memory (RAM) and shared registers to create a form of keyboard image within the RAM. Through the use of the memory and other storage devices, both present and past keyboard data are used to determine harmony notes. The microprocessor has sufficient computational power to allow implementation of a number of logical rules that determine the validity of keyboard data. An output memory, which operates asynchronously with respect to the input memory, sounds the muscial effects upon completion of the associated new note determinations.

The harmony notes which are generated can by rhythmically modulated so as to sound as a plurality of individual beats sounded simultaneously or rhythmically spaced from the solo note in order to create unusual harmonic effects.

One object of the present invention is the provision of an automatic note generator having plural harmony modes selectable so as to produce single and plural notes in true closed or open harmony. The harmony notes can be less than the number of actuated accompaniment notes, can be shifted in octave, folded back, entirely discarded, adjusted in volume level separate from the solo notes, and otherwise altered so as to prevent discord and create pleasing musical effects.

Another object of the present invention is the provision of a generator which assigns different note names to the keyswitches of a keyboard in accordance with actuated keys on another keyboard. The generator can alter the pattern and spacing of notes allocated to the keyswitches.

Still another object of the invention is the provision of an electronic organ utilizing a microprocessor to implement unique rules as to the validity of keyboard data and the types of notes to be generated. An associated memory stores images of both present and past keyboard actuations. The microprocessor circuit is compatible with the other circuitry of integrated circuit electronic organs and operates essentially in parallel therewith to allow an add-on capability to present digital electronic organs.

It is a further object of the invention to use a microprocessor system for the purpose of harmony generation, thereby permitting various musical rules to be applied in the determination of the harmony notes to be sounded and permitting the use of various logical rules to determine when keyboard data should be recognized as valid for purposes of harmony determination.

Other objects and features of the invention will be apparent from the following description and from the drawings. While an illustrative embodiment of the invention is shown in the drawings, and will be described in detail herein, the invention is susceptible of embodiment in many different forms and it should be understood that the present disclosure is to be considered as an exemplification of the principles of the invention and is not intended to limit the invention to the embodiment illustrated.

BRIEF DESCRIPTION OF THE DRAWINGS

FIGS. 2A–2E illustrate several bars of music in which FIG. 2A illustrates notes produced by the organist and FIGS. 2B–2E illustrate the resulting notes generated by the circuit of FIG. 1;

FIG. 9A is a memory map showing the memory locations allocated to input note and switch information stored in the RAM of FIG. 1;

FIG. 9B shows the outputs of the 1-of-10 decoder as related to the memory map of FIG. 9A;

FIG. 10 is a memory map showing the memory locations allocated to output note information stored in the RAM of FIG. 1;

FIGS. 11A–11D illustrate operations performed on data from one of the registers, R5, in the microprocessor during the process of determining the highest harmony note;

FIG. 12 shows a simplified flow chart of the basic system software stored in the ROM of FIG. 1; and FIGS. 13A–13G are flow charts of the details of the scan, process, arpeggio, and harmony finding shown in block form in FIG. 12.

SYSTEM OPERATION

Figure 1:
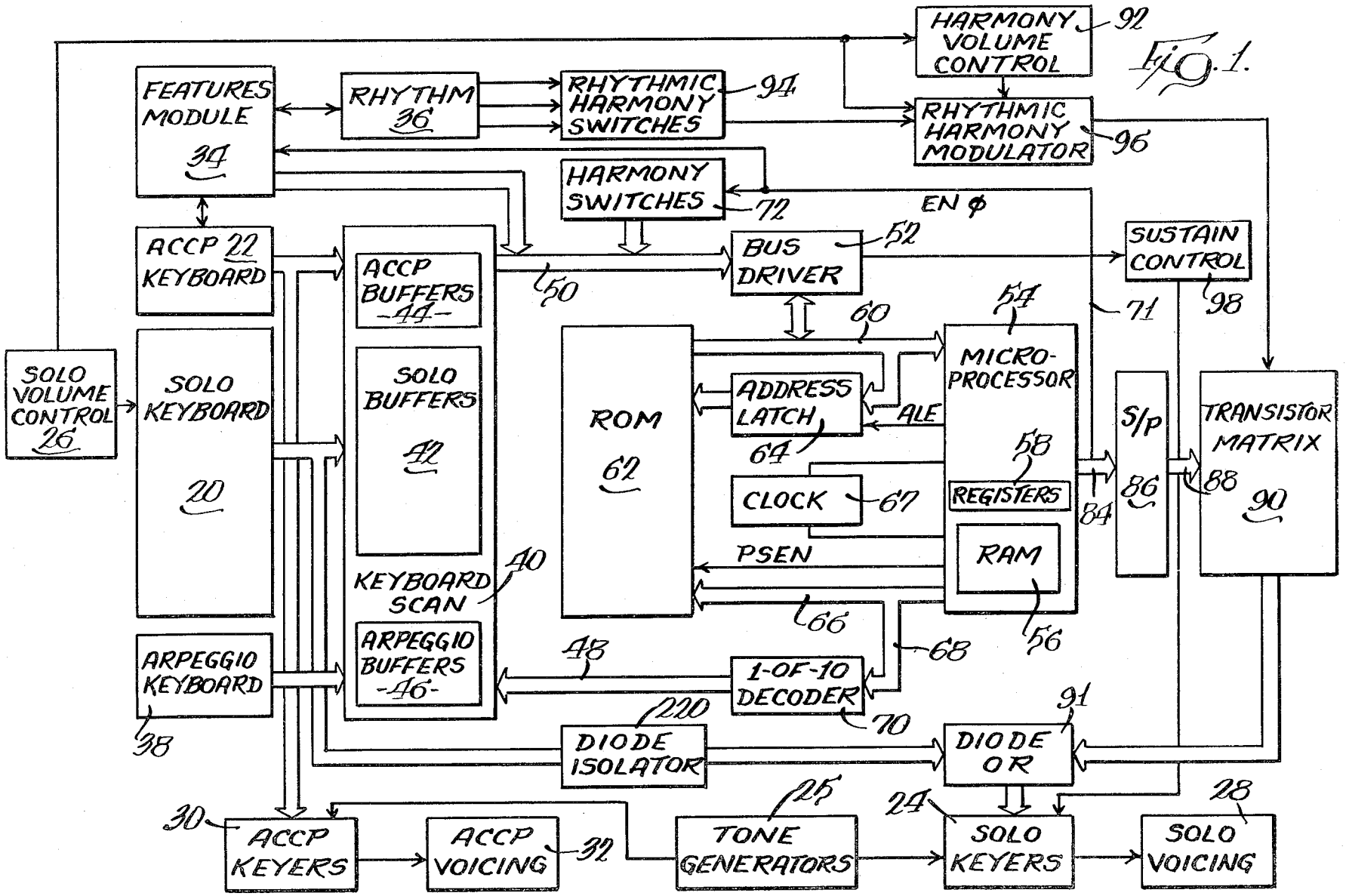
FIG. 1 is a block diagram of the electronic musical instrument including the harmony generating circuit.

FIG. 1 illustrates an electronic musical instrument such as an electronic organ which includes circuitry for automatically generating harmony notes and arpeggio notes in response to actuation of keyboards and tab switches on the organ. A solo keyboard 20, which may be conventional, includes a plurality of keyswitches each corresponding to different notes. Each group of twelve keyswitches correspond to the standard twelve notes, C through B, for a given octave of the organ. A standard accompaniment keyboard 22 includes plurality of keyswitches corresponding to notes in the accompaniment range of the organ and may cover several octaves.

When an individual keyswitch on the solo keyboard 20 is actuated, a voltage representing the actuated note is passed to conventional solo keyers 24 which have a separate keyer corresponding to each note on the solo keyboard.

The solo keyers are coupled to tone generators 25 which may be formed by a top octave synthesizer coupled to dividers for generating a plurality of frequencies each corresponding to a different note which can be played by the organ. The volume of the solo note is determined by a solo volume control 26 which may comprise a potentiometer manually adjustable by the organist to generate a voltage magnitude corresponding to the desired sound volume. The outputs of the solo keyers 24 are coupled to solo voicing circuitry 28 which then sounds notes, corresponding to the actuated solo keyswitches, in a voice as determined by conventional voicing tabs (not illustrated) which are selected by the organist. The voicing tabs may also shift the range of the solo keyboard such as occurs if the organist selects an 8 foot voice, a 4 foot voice and so on.

The accompaniment keyboard 22 is coupled to accompaniment keyers 30 which have a separate keyer for each note on the accompaniment keyboard. The accompaniment keyers are coupled to the same tone generators 25. The output of the accompaniment keyers 30 are coupled to accompaniment voicing circuitry 32 which then sounds accompaniment notes in the accompaniment range of the organ and with a voice determined by the setting of standard tab switches (not illustrated) selected by the organist. The voicing selected for the accompaniment notes is independent of the voicing selected for the solo notes.

The electronic organ includes a feature module 34 which provides a number of standard features actuable when various tabs (not illustrated) on the organ are selected by the organist. Module 34 provides a single finger chord (SFC) feature that allows the organist to play only a single keyswitch on the accompaniment keyboard 22, while the features module 34 generates and plays, through keyers internal therein, additional notes which are chordally related to the actuated note. A chord memory can be selected through a tab switch to memorize the entire chord and continue actuation of the accompaniment keyers even though the organist ceases to actuate the accompaniment keyboard. The features module 34 also allows the automatic selection of a 7th chord or a minor chord rather than a major chord, depending on the type of pedal depressed by the organist. By way of example, the features module 34 may take the form illustrated in U.S. Pat. Nos. 4,031,786 and 4,046,047.

A rhythm circuit 36 produces notes in rhythmically varying patterns which repeat at a duration selectable by the organist. As is conventional, the types of patterns can be selected as are appropriate to the music to be played, and at a repetition rate selectable by the organist on a repetition rate control. The rhythm circuit 36 has standard circuit connections to the features module 34, and has an internal modulator and keyer in order to output cyclical rhythmic patterns of notes.

In order to produce an arpeggio sound, a separate arpeggio keyboard 38 is provided which is a reduced version of an ordinary keyboard. This substantially shortened keyboard can be mounted adjacent the solo or accompaniment keyboard and is intended to be actuated by the organist running his finger across a strip of touch contacts when it is desired to produce an arpeggio effect. The arpeggio keyboard 38, per se, is known and allows the operator to produce arpeggio sound corresponding to individual keyswitches that the organist maintains actuated on the accompaniment keyboard.

The electronic organ circuit to the extent described above is conventional and may take a variety of forms other than that illustrated. For clarity, other standard features have been omitted from the drawing, but would be present, such as a pedal keyboard and a variety of tab switches for selecting different types of voicing.

In accordance with the present invention, the keyboards 20, 22 and 38, and certain of the tab switches and other input devices of the electronic organ, are connected to unique circuitry for scanning the input devices and generating notes therefrom which are musically related to the notes played either by the organist or generated automatically by other standard circuits of the organ such as the features module. The unique circuitry allows generation of harmony notes which are musically related to the notes played on the solo and accompaniment keyboards. The harmony notes generated can be in open or closed harmony relationship and are not simply a representation of currently played accompaniment notes shifted to the octave below the highest solo note. Rather, the number of harmony notes, and their octave locations including different octaves for spaced harmony notes, are generated so as to produce a true harmony effect. In addition, these automatically generated harmony notes may be rhythmically modulated before being sounded with the melodies played on the solo keyboard.

The unique circuitry also has improved portions for generating the arpeggio notes as the organist sweeps his finger across the arpeggio keyboard. With the improved circuitry, the individual actuable switches of the arpeggio keyboard do not correspond to a fixed note or number of notes but rather are assigned note names dependent on the notes being actuated on the accompaniment keyboard. The assigning of note names and empty keyswitches, if necessary, is automatically varied depending on the number of actuated keyswitches on the accompaniment keyboard.

The single or plural note harmony which is automatically generated then keys the solor keyers so as to be produced with the solo voice. This is to be contrasted with the chordally related notes produced by the feature module 34, which produces chords sounded with an accompaniment voice. Furthermore, the harmony notes may be adjusted in volume level separate from the solo notes.

As seen in FIG. 1, each keyboard 20, 22 and 38, is coupled to a keyboard scan circuit 40 which scans the actuated or unactuated status of the individual keyswitches. While separate solo and accompaniment keyboards have been illustrated, it will be understood that the terms solo keyboard means and accompaniment keyboard means encompasses a single keyboard having solo and accompaniment portions, and separate tab switches or voicing associated with those portions. The keyboard scan circuit 40 includes solo buffers 42 for receiving notes from the solo keyboard 20, accompaniment buffers 44 for receiving notes from the accompaniment keyboard 22, and arpeggio buffers 46 for receiving actuated keyswitch locations from the arpeggio keyboard 38. Each buffer has six input lines and six output lines. Six of the buffers are used for solo keyswitch information. Since, for harmony generation, only the actuated accompaniment note names need to be provided, two buffers are provided to gate the accompaniment keyboard information. Finally, two buffers are utilized for the arpeggio switch locations.

Each of the ten buffers in the keyboard scan circuit 40 is individually gated when its corresponding enable line, of ten enable lines forming an enable bus 48, is actuated. At that time, the buffer passes or gates the six input lines thereof to the first six of eight lines of a data bus 50. Sequential actuation of the ten enable lines of bus 48 then gates the buffers, in the order determined by a microprocessor, onto the data bus 50. The data on the bus is buffered by a bus driver 52 which isolates the data for transmission to a central processing unit.

The central processing unit includes a microprocessor 54 which includes a random access memory or RAM 56 for storing data, and a plurality of direct access registers 58 for storing and manipulating data. Illustratively, the microprocessor may be an Intel P-8035L processor in which the RAM has a capacity of storing 64 words, each word consisting of 8 bits (one byte). The microprocessor includes a crystal clock 67 which generates a clock frequency of 3.579 MHz.

The central processing unit also includes a read only memory or ROM 62 which contains all of the software instructions in the system. Illustratively, the ROM may have a capacity of 2K×8 bits may be formed by an Intel 2316 integrated circuit.

The data from the bus driver 52 are sent to the microprocessor 54 over a bidirectional data bus 60, which also sends data from the microprocessor 54 to an address latch 64. The ROM is addressed by the data held in the address latch 64 and by address data sent on bus 66 from the microprocessor 54. The address data thus received by ROM 62 determines which instruction word is to be sent back to the microprocessor on bus 60.

The microprocessor can be considered, in a simplified manner, to have two cycles, a fetch cycle and an execute cycle. During the fetch cycle, an address is sent by the microprocessor to address latch 64. The microprocessor 54 sends an address latch enable signal (ALE) to the address latch 64 instructing the latch to hold the data for time long enough for the ROM 62 to read it as an address. During this fetch cycle, ROM 62 is addressed by an 11 bit binary code, 8 bits of which come from the address latch 64 and 3 bits of which come from the microprocessor 54 on bus 66. This 11 bit binary code received by the ROM 62 during the fetch cycle determines which instruction word is to be sent back to the microprocessor 54. The instructions from ROM 62 are sent to the microprocessor on bus 60 when ROM 62 receives a signal PSEN from the microprocessor 54.

During the execute cycle, the microprocessor receives keyboard status data and makes all the decisions necessary for harmony finding and arpeggio processing. It is during this cycle that the microprocessor sends an address, in the form of a 4 bit binary signal, on bus 68 to a 1-to-10 decoder 70. The output of the 1-to-10 decoder 70 comprises the 10 output enable lines which form bus 48. Each different enable is coupled to an individual one of the ten buffers within the keyboard scan circuit 40. The decoder 70 decodes the binary address on the bus 68 and actuates a single one of the 10 output lines so as to gate the corresponding buffer in keyboard scan 40 onto the data bus 50 during this data acquisition cycle.

Figure 2:
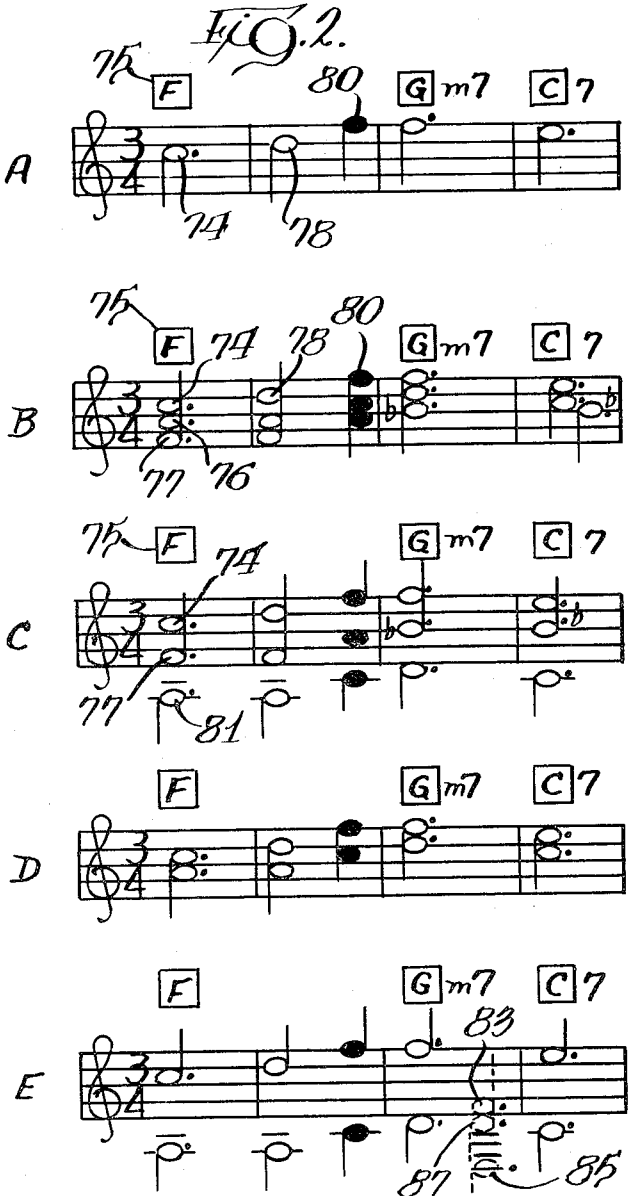

After the ten individual signals from the 1-to-10 decoder 70 have been generated, the microprocessor 54 generates an EN$\phi$ signal which is sent over a line 71 to harmony switches 72 and to the features module 34. There are four harmony switches 72 which correspond to basic harmony, theater harmony, harmony duet, and counter melody, each of which will be described with reference to FIG. 2. Upon receiving the EN$\phi$ signal, the harmony switches 72 are logically connected so as to provide a 4 bit binary status word in which each bit of the word corresponds to the on or off state of one of the four switches. This status word is gated onto the bus 50 along with a four bit status word from the features module 34. The resulting 8 bit word is then sent to the microprocessor 54 through the bus driver 52. From the data received from the keyboard scan 40, the harmony switch 72, and the features module 34, the microprocessor 54 determines the appropriate harmony and arpeggio notes to be generated.

The harmony notes generated by the harmony circuit may be understood with reference to FIGS. 2A–E which show four bars of music to the tune "I Love You Truly". FIG. 2A illustrates the notes C, D, F, F and E which are the solo notes played by the organist on the solo keyboard. On the accompaniment keyboard, the accompaniment chords F, G minor seventh (Gm7) and C seventh (C7) are produced, which chords are indicated by the squares in FIG. 2A. For purposes of the present invention, it is immaterial whether the organist has produced the chords, or the organist has selected the single finger mode on the features module 34 and the feature module is producing the additional chordal notes which accompany the single accompaniment note actuated by the organist.

FIGS. 2B–2E show several examples of the resulting notes which are produced depending on which of several harmony modes have been selected by the organist on the harmony switches 72 of FIG. 1. As will be described, four harmony switches are provided which can be actuated singly or in various combinations. When only the basic harmony switch is selected, the result is shown in FIG. 2B. When only the theater harmony switch is selected, the result is shown in FIG. 2C. Actuation of only the harmony duet switch produces FIG. 2D, and actuation of only the counter melody switch produces the musical result shown in FIG. 2E. The combinations of the switches are actuated, different results are produced which will be described in detail later.

The harmony notes produced in FIGS. 2B and 2D represent closed harmony in which the generated harmony notes are sounded in the first octave immediately below the highest note played on the solo keyboard. The harmony notes produced in FIGS. 2C and 2E represent open harmony in which a harmony note is sounded in the second octave below the highest solo note (it being noted in FIG. 2C that the remaining harmony notes are sounded in the first octave immediately below the highest solo note). As used herein, the phrase first octave or adjacent octave below the highest solo note refers to the first twelve notes falling below the highest solo note played by the organist on the solo manual. The plurality of harmony modes which can be selected produce a realistic harmony effect which was not heretofore possible with automatic circuitry.

As an example, the notes resulting from the basic harmony mode, FIG. 2B, will be described in more detail. As seen in the first bar of music, the solo C note 74 was actuated by the organist and is produced in a standard manner. The F chord which was selected by the organist comprises the notes C-A-F (either by individual actuation of those notes on the accompaniment keyboard or by actuation of the C note on the accompaniment keyboard with actuation of the single finger chord mode in the features module). The harmony generator of the present invention then automatically generates the harmony notes 76 and 77 which key the solo keyers to-produce harmony notes in the solo range and with the solo voices.

As will be explained later, the harmony generator determines the harmony notes based on the highest solo note 74 and the accompaniment notes, in this example, chord 75. To avoid discord, the harmony generator does not produce notes within a minor third, i.e. the three half-steps, below the highest solo note 74. Since the F chord comprises the notes C, A, F, the first accompaniment note C within the F chord is initially skipped during harmony determination because it is within three half-steps of the solo note 74, which in FIG. 2B is also a C note. After initially skipping the first three half-steps, the next two chord note names are then A and F. Because the basic harmony mode which was selected generates a plurality of harmony notes in closed harmony, the found A and F notes are sounded in the first octave immediately below the highest solo note, producing the results seen in FIG. 2B.

It should be noted that, during harmony determination, the first three half-steps initially skipped are returned to after looking at the other nine note locations, so that an entire octave is covered. If the second needed note is within the first three half-steps, for example, it is considered as the second found note even though it was closer to the highest solo note.

As seen in the second bar of music in FIG. 2B, the organist has changed the solo note to the D solo note 78 while the accompaniment chord F remains actuated. Since the first note name C of the F chord is still within three half-steps of the solo note, the harmony ignores the C note and the result, as previously described, is generation of the harmony notes A and F.

In the same second bar of music, when an F solo note 80 is actuated by the organist, along with the same F chord, the resulting harmony notes change to notes C and A. The harmony generator determined that the first chord note C was no longer within three half-steps of the highest solo note, now an F, and therefore, determined the harmony notes should be a C and A, sounded within the first octave immediately below the highest solo note 80 now being played.

When the theater harmony mode has been selected, as seen in FIG. 2C, a pair of harmony notes are generated which are sounded in open harmony. As seen from the first bar of music, the same C solo note 74 and the F accompaniment chord 75 result in the same note names A and F for the harmony notes. However, while the second F harmony note 77 is sounded in the same location, the first A harmony note is dropped one octave as seen by note 81. The result is a pleasing and musically correct open harmony which has not been automatically generated with prior harmony generators. The harmony note which is shifted to the second octave immediately below the highest solo note is the harmony note first closest, in note name, to the highest solo note (after adjusting for a minor third).

When in the harmony duet mode, FIG. 2D, only one harmony note is sounded in closed harmony. The single harmony note is that closest to the solo note (after adjusting for the minor third).

When in the counter melody mode, FIG. 2E, one harmony note is sounded in open harmony. In addition, the counter melody switch actuates a harmony memory so that all harmony notes generated at that time are stored and continue to sound as long as a solo note and/or an accompaniment note is played. While FIG. 2E has only one harmony note which remains actuated, the simultaneous actuation of other harmony switches in combination with the counter melody switch will result in other or additional harmony notes which are memorized and will continue to sound even though the organist removes his hand from the solo keyboard.

It is not necessary that the harmony generator be capable of producing harmony notes corresponding to each note on the solo keyboard. By way of example, when a conventional 44 note keyboard is used, it is sufficient if the harmony generator produces notes beginning one note below the lowest key on the solo keyboard and extending upward for the first 33 notes of the keyboard. Depending on the location of the highest solo note played and the mode of harmony operation selected, it is sometimes necessary to fold back the harmony note into an octave above the octave in which the note would normally have been sounded. Such foldback is necessary when the frequency of the harmony note to be sounded becomes so low that the sound produced in conjunction with the solo note becomes somewhat "muddy" or unpleasant. This generally occurs when the harmony note falls within the octave below the lowest note on the solo keyboard.

In some instances it may be desirable to effect foldback of the harmony note at some point well above the lowest note of the solo keyboard, such operation being comprehended within the scope of the present invention. In no case, however, should a harmony note be folded back to a position which causes it to be sounded above the highest solo note. The present invention prevents the sounding of such harmony notes.

Foldback provides a particularly interesting result in the counter melody mode of operation seen in FIG. 2E. For a given solo passage, the counter melody harmony mode produces harmony notes that are lower in frequency than the notes produced by the basic harmony and harmony duet modes. This causes foldback to occur more often in the counter melody mode of operation, and results in the production of a harmony that appears to move in a less predictable, more complex manner than the harmony produced by the basic harmony or harmony duet modes. This is due to the one octave jump in the harmony note that the foldback occasionally provides.

The effect of harmony foldback can be seen with reference to the dashed lines in FIG. 2E. Assuming that the user played the melody note F, designated 83 in dashed lines, instead of the F illustrated originally, the harmony generator would attempt to produce the harmony note D, shown at 85, within the second octave below the octave containing the solo note 83. The harmony note 85 falls below the lowest note on the solo keyboard and is therefore automatically folded back and sounded in the note location designated 87.

Returning to FIG. 1, the microprocessor 54 determines the individual harmony notes, and their octave location, and stores the resulting harmony note identifications in an input memory portion of the RAM 56. After the harmony notes have been determined, they are stored in an output memory portion of the RAM 56 and are then dumped serially onto an output data bus 84 which is coupled to a serial to parallel (S/P) converter 86. The output memory portion and the input memory portion of the RAM 56 operate asynchronously and independently as will appear.

The S/P converter is essentially a shift register having thirty-three parallel output lines 88 which are coupled to thirty-three transistors within a transistor matrix 90. Each individual transistor within the matrix 90 corresponds to an individual harmony note which can be sounded within the range of the solo keyboard. Each transistor in the matrix is coupled to a corresponding diode, in a diode OR circuit 91, which couples the transistor to an associated individual solo keyer corresponding to the transistor. Thus, each actuated transistor in the transistor matrix 90 actuates a corresponding solo keyer to sound the harmony notes with a solo voicing. Furthermore, the harmony generator is in parallel with the direct keying of the solo keyers 24 produced by actuation of the solo keyboard 20.

As previously described, the volume of the solo notes actually played on the solo keyboard 20 is regulated by a solo reference voltage from the solo volume control 26. The volume of all notes generated by the harmony generator is independently regulated by a harmony volume control 92 which supplies a volume control voltage to the transistor matrix 90. The voltage supplied by the harmony volume control 92 is generally equal to or less than the solo reference voltage from the solo volume control 26, so that the harmony note volume will not be greater than the volume of the solo notes actually played, unless the rhythmic harmony switches 94 are actuated.

The rhythmic harmony switches 94 consist of three individual switches, labelled I, II and III, as will be explained later, which can be individually actuated to modulate the harmony notes in a rhythmic pattern controlled by the rhythm generator 36. The individual rhythmic harmony switches 94 select one of several pulse patterns from the rhythm generator 36 and couple the same to a rhythmic harmony modulator 96 having outputs coupled to the transistor matrix 90. The pulse patterns determine the time spacing or beats of the harmony notes, and/or brings the harmony volume level above the solo note volume level for short time periods.

The resulting rhythmically modulated harmony notes are shown in FIGS. 3A–C which show the output of both the solo and accompaniment portions of the organ for the same melody produced by the organist in FIG. 2A. FIG. 3A illustrates the rhythmic modulation of the harmony notes when the rhythmic harmony switch I is actuated; FIG. 3B illustrates the same for actuation of rhythmic harmony switch II; and FIG. 3C illustrates the rhythmic harmony modulation for actuation of rhythmic harmony switch III.

As seen in FIG. 3A, for example, the same C solo note 74 and F accompaniment chord 75 in the first bar of music results in generation of the same A and F harmony notes shown in FIG. 2B (the same basic harmony mode being selected), but the A and F harmony notes 100 are no longer sounded as a chord with the first C solo note 74. Instead, the harmony notes 100 are sounded rhythmically beginning one beat later and then sounded successively for the last two beats of the measure. The accompaniment notes 104 of the chord are sounded in a somewhat similar manner due to the operation of the standard features module 34 and rhythm circuit 36. Thus the harmony notes are sounded in a beat synchronism with the modulated accompaniment notes.

Actuation of a different one of the rhythmic harmony switches 94 produces a different pattern of rhythmic modulation as can be seen in the remaining FIGS. 3B and 3C. In each case, the harmony notes have the same note names and locations, but are sounded in a rhythmically modulated pattern which produces a unique sound different from simultaneous harmony sounding.

Besides generating harmony notes, the microprocessor 54 and associated circuitry also generate arpeggio notes when the arpeggio keyboard 38 has been played. Whenever arpeggio notes are being automatically generated and stored in the output memory portion of the RAM 56, FIG. 1, a signal is sent over the bi-directional bus 60 to the bus driver 52. This signal is then sent to enable a conventional sustain control 98. The sustain control 98 is an electronic switch which, when turned on, opens a +10 volt sustain dump line that is used to discharge all of the sustain capacitors which are provided in a standard manner in each of the solo keyers 24. The sustain capacitors then cannot discharge rapidly and the solo keyers 24 are held on for a longer period of time, which results in a sustain. When arpeggio notes are no longer being produced, the control signal is removed from the sustain control 98.

As can now be appreciated from FIG. 1 and the foregoing description of the system operation, the harmony generator of the present invention comprises, in essence, a module that can be added to a conventional electronic organ and operates in parallel with the circuitry already present to provide an added harmony. The basic components of the harmony module comprise the scan circuit 40, the microprocessor 54, ROM 62, S/P converter 86, the harmony switches 72, the harmony volume control 92 and modulator 96, and the transistor matrix 90 and related circuits.

While RAM 56 includes input and output memory portions and may be integral with the microprocessor, separate storage devices may be provided. Furthermore, storage devices such as the output memory in RAM 56 and the hardwired storage matrix 90 could be combined by using direct memory access or other techniques to provide high speed access and are within the scope of the invention.

DETAILED OPERATION

Figures 8, 11:
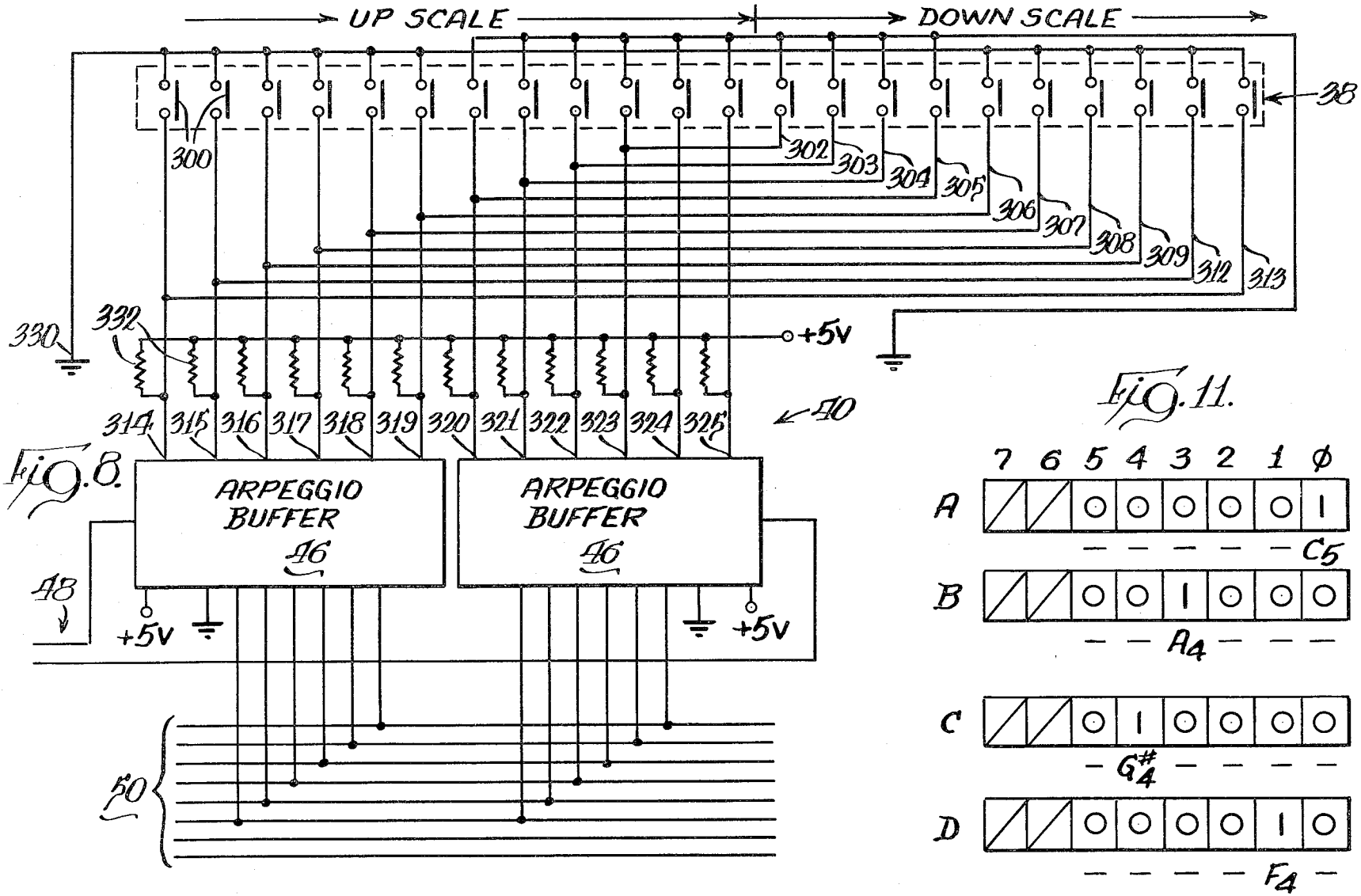
FIG. 8 is a schematic diagram of the arpeggio keyboard and related buffers in the keyboard scan circuit shown in block form in FIG. 1.

The keyboard scan circuit 40, as seen in FIG. 1 and in FIG. 8 for the portion associated with the arpeggio buffers 46, is composed of a total of ten tri-state buffers. Each buffer has six inputs from the keyswitches of its associated keyboard, and six outputs. Each individual buffer may be a standard tri-state hex inverter having three output states, high, low, and a third state which is high impedance. These three states allow the six output lines of each buffer to be commonly wired to the data bus 50. Data bus 50 consists of eight bus lines, but only six of the lines are used with respect to the buffers within the keyboard scan circuit 40. Each buffer is enabled by its associated line from the 1-of-10 decoder 70.

For harmony finding, only the note name of the actuated accompaniment keys is needed, so the accompaniment keyswitches having the same note names are connected together by a diode OR gate to provide twelve inputs to the accompaniment buffers 44, which thus represent the note names of the accompaniment keys irrespective of octave. Unlike prior systems, the harmony generator of the present invention uses digital words representing the accompaniment note names along, without octave information.

The six solo tri-state buffers 42 allow the keyboard scan 40 to recognize thirty-six solo notes played on the solo keyboard. Each output from the solo buffers represents a particular solo note in a particular octave. The arpeggio touch keyboard has twenty-two contacts which are connected together by diode OR gates to provide twelve inputs to the two associated arpeggio buffers 46, as will be explained later with reference to FIG. 8.

Figures 4, 5:
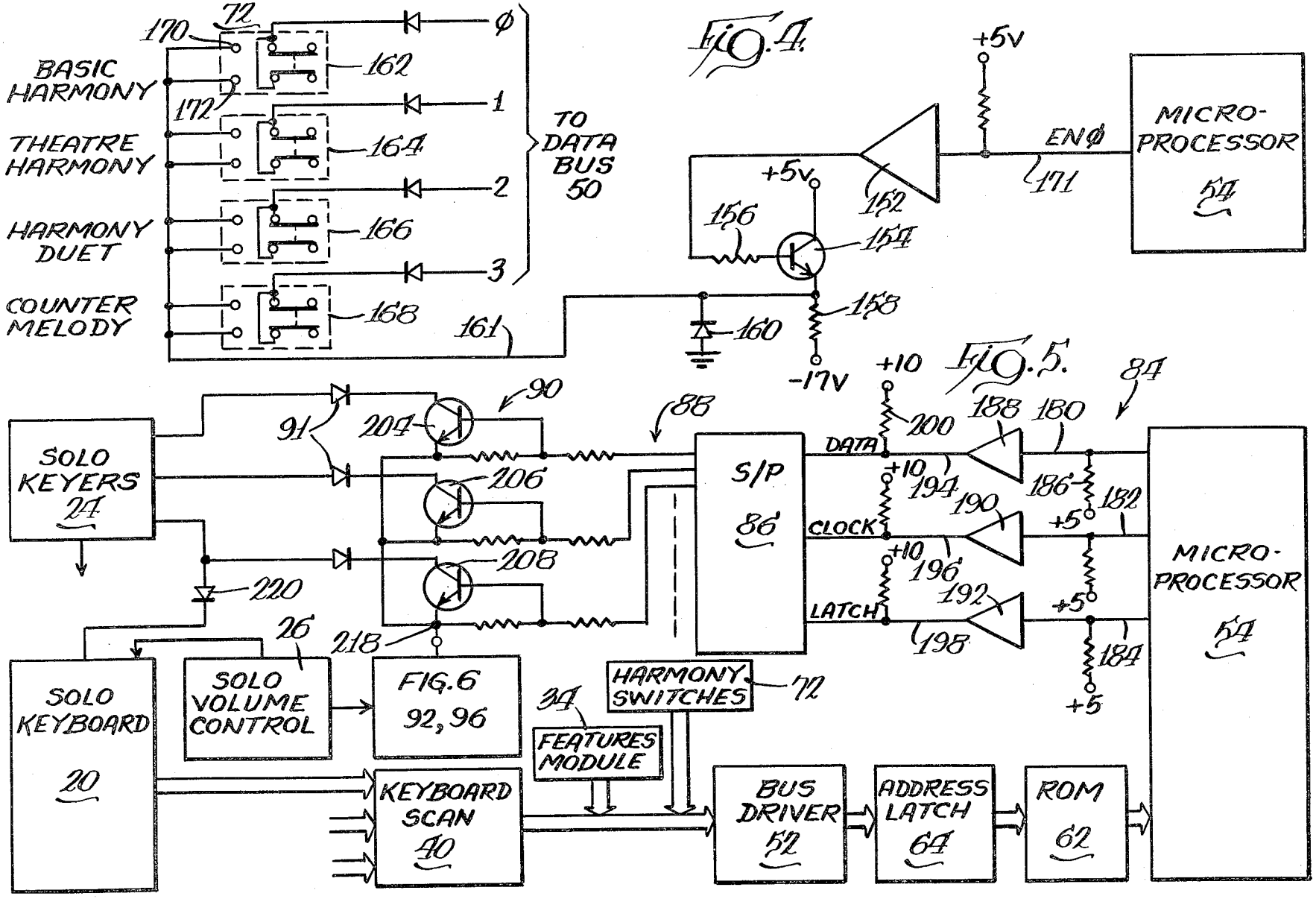
FIG. 4 is a schematic diagram showing details of the harmony switches and related circuits, shown in block form in FIG. 1.
FIG. 5 is a schematic diagram showing details of the output between the microprocessor and the solo keyers including the serial to parallel converter and portions of the transistor matrix, which are shown in block form in FIG. 1.

FIG. 4 illustrates in detail the harmony switches 72 and their interconnection to the output of the microprocessor 54. The harmony switches themselves consist of four switches 162, 164, 166 and 168, which can be actuated individually or in combination. In order to read the actuated states of the switches, the microprocessor 54 generates an EN$\phi$ signal on line 71. This is a low going signal, and when it appears at the input of a buffer 152, a low state appears which is coupled to the base of an NPN transistor 154 through a resistor 156. The collector of transistor 154 is connected to a +5 volt supply and the emitter of transistor 154 is connected to negative −17 volt supply through a resistor 158. When the low state is applied to the base of transistor 154, the transistor stops conducting and allows its emitter to fall toward its negative potential, which is limited to a negative −0.6 volts by a diode 160. This signal is applied over a line 161 to the inputs of the four harmony switches.

The harmony switches 72 consist of four individual switches 162, 164, 166 and 168 which respectively correspond to basic harmony, theater harmony, harmony duet, and counter melody. All of the four harmony switches which are shown in their off position. If, for example, the basic harmony switch 162 was selected, the switch slider would be moved to the left to a position to connect the first data line $\phi$ of the data bus 50 to contacts 170 and 172. The low state from transistor 154 would then appear on data bus line $\phi$ which is one of the eight lines of data bus 50. This low condition on bus line $\phi$ would indicate that the basic harmony switch had been selected.

Since the harmony switches 72 can be actuated in various combinations, the resulting 0 and 1 bits on the four lines of the data bus 50 represent the actuated states of the harmony switches. The various resulting harmony note combinations are described in the chart below labeled Table I. A "0" bit corresponds to the individual harmony switches in their off position and an "I" bit corresponds to the switches in their on position, resulting in a low condition on the respective bus lines $\phi$-3 of the data bus 50.

TABLE I

| | Switch Actuations | | | | Result | | |
|---|---|---|---|---|---|---|---|
| Ref. # | Basic Harmony | Theater Harmony | Harmony Duet | Counter Melody | No. of Notes | Open/ Closed | Harmony Memory |
| 1 | 0 | 0 | 0 | 0 | no harmony generated | | |
| 2 | I | 0 | 0 | 0 | 2 | closed | off |
| 3 | I | I | 0 | 0 | 2 | open | off |
| 4 | I | 0 | I | 0 | 1 | closed | off |
| 5 | I | 0 | 0 | I | 2 | closed | on |
| 6 | I | I | I | 0 | 1 | closed | off |
| 7 | I | 0 | I | I | 1 | closed | on |
| 8 | I | I | 0 | I | 2 | open | on |
| 9 | I | I | I | I | 1 | open | on |
| 10 | 0 | I | 0 | 0 | 2 | open | off |
| 11 | 0 | I | I | 0 | 1 | open | off |
| 12 | 0 | I | 0 | I | 2 | open | on |
| 13 | 0 | I | I | I | 1 | open | on |
| 14 | 0 | 0 | I | 0 | 1 | closed | off |
| 15 | 0 | 0 | I | I | 1 | closed | on |
| 16 | 0 | 0 | 0 | I | 1 | open | on |

Because the harmony switches 72 can be used in various combinations, only four individual switches allow a large number of unique combinations to be selected. Furthermore, the combinations are predetermined to produce pleasing results for various combinations of the switches so that the organist is not overwhelmbed with a multiplicity of switches having more combinations than the organist could remember if individually set forth.

Although there are sixteen combinations of switch settings, it should be noted that the resulting outputs produced thereby are redundant in several instances and that there are actually eight unique settings. For example, it can be seen that the actuation of the basic harmony and theater harmony switch, reference number 3, produces the same output as the actuation of the theater harmony switch alone, reference number 10. Both produce two harmony notes in open harmony, without the harmony memory feature being actuated. The resulting output for either of these combinations is that previously described with reference to FIG. 2C, in which it can be seen that two harmony notes are generated, labelled 77 and 81 in FIG. 2C, and that note 81 is displaced one octave so as to produce open harmony.

When the counter melody switch 168 is actuated, the memory feature will be on, and when the counter melody switch is off, the memory feature will be off, i.e., the harmony note will not be memorized and held when the organist removes his finger from the solo keyboard.

It is noted that the reference number 6 in the above table does not produce the expected result, based on the trend of the pattern combinations, of one note in open harmony. When the microprocessor sees the switch combination IIIO, it treats this code as though the switch combination OOIO had been received, resulting in one note of closed harmony. Similarly, the sixteenth reference switch combination OOOI is treated as the form of OIII, resulting in one note in open harmony with the memory feature on.

FIG. 5 shows how the output from the microprocessor 54 is transmitted to the solo keyers 24. The harmony notes, and arpeggio notes, will have been stored in the RAM of the microprocessor in an output memory section, to be described later with reference to FIG. 10. When this output memory is dumped, the note data stored therein are serially placed on the serial data output line 180. The output line 180, as well as a clock line 182 and a latch line 184, are tied to +5 volts through a 15K (kilohm) resistor 186. The output signals appearing on lines 180, 182 and 184 pass through isolators or buffers 188, 190 AND 192 respectively to the serial to parallel S/P converter 86. Each of the output lines 194, 196, and 198 from the isolators are tied to +10 volts through a 4.7K resistor 200.

The series to parallel S/P converter 86 is essentially a shift register. The serial output data on line 180 are loaded into the shift register under the control of a clock signal provided on the output line 182. This serial data remains in the serial to parallel converter until an end of transmission pulse is placed on line 184. The resulting low state latch pulse actuates an internal latch in the serial to parallel converter 86 to output the signals held in the shift register onto thirty-three parallel lines 88 coupled to the transistor matrix 90.

The transistor matrix 90 consists of thirty-three transistors, each transistor corresponding to a different note on the solo keyboard. For clarity, only three transistors 204, 206 and 208 and their associated circuitry are shown in FIG. 5. When the serial to parallel converter 86 is actuated, a $\phi$ volt condition appears on each of the output lines 88 to forward bias the associated keyer transistor in the transistor matrix 90. The collectors of each transistor in the matrix are connected to the solo keyer 24 through individual OR diode gates 91.

Figure 6:
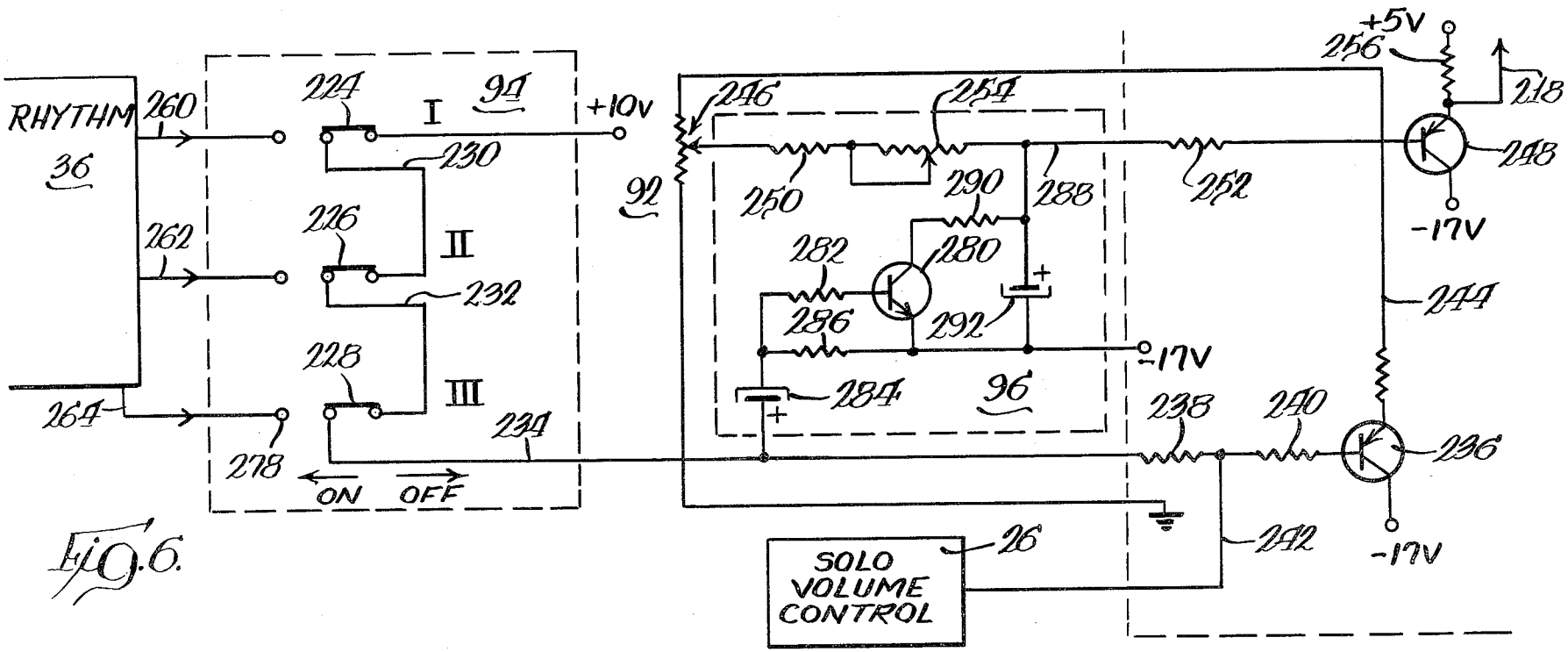
FIG. 6 is a schematic diagram of the rhythmic harmony switches, the harmony volume control, and the rhythmic harmony modulator shown in block form in FIG. 1.

Each of the emitters of the transistors 90 are tied to a common line 218 from the harmony volume control 92 and rhythmic harmony modulator 96 shown in FIG. 6. As will be described, a negative DC keying voltage is applied over line 218 to the common emitters to regulate the volume of the harmony notes. These circuits are also tied in to the solo volume control 26 so as to regulate the level of the harmony volume control with respect to that set on the solo volume control.

In addition, the solo volume control 26 provides a keying voltage, at a selected magnitude, to the solo keyboard 20 which in turn passes the voltage through diode isolators 220, in a standard manner, to direct key each of the solo keyers 24. The diodes 220 isolate the direct keying voltage selected by the solo volume control from the harmony keying voltages placed on line 218.

Figure 3:
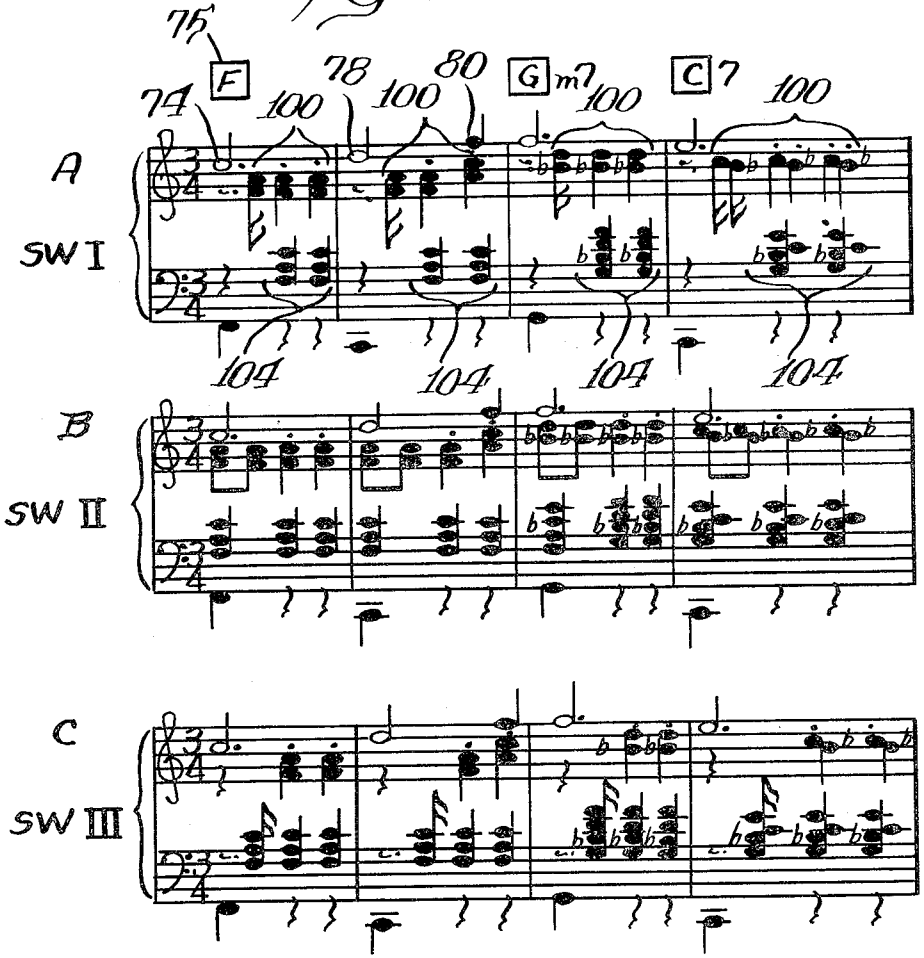
FIGS. 3A–3C illustrate several bars of music which result from harmony generation when combined with actuation of one of three rhythmic harmony switches.

FIG. 6 illustrates in detail the harmony volume control 92, the rhythmic harmony modulator 96, and the rhythmic harmony switches 94 which allow selection of one of the three types of rhythmic harmony modulations shown in FIG. 3. The rhythmic harmony switches 94, FIG. 6 consist of three individual slide switches 224, 226 and 228, respectively labelled as I, II, III. Only one of these switches should be actuated at a time. If more than one is on, switch III takes priority over switches II and I; and switch II take priority over switch I.

When the rhythmic harmony switches 94 are in the off position as shown in FIG. 6 the switches 224, 226 and 228 and lines 230, 232 and 234 provide a series connected path for a +10 volt supply to the base of a PNP transistor 236 through series connected resistors 238 and 240 having values of 12K and 33K, respectively. This potential, along with the solo reference potential from the solo volume control 26, as supplied on line 242, provides the proper biasing of transistor 236. The potential applied to the base of transistor 236 controls the potential sent on line 244 to a potentiometer 246 which acts as the harmony volume control 92. The other end of the potentiometer 246 is grounded to as to allow any level of harmony, between zero and the preset solo volume, as determined by the solo volume control 26. This allows the volume of the harmony notes to be played at any level equal to or less than that of the solo notes actually played.

The rhythmic harmony modulator 96, FIG. 6 is coupled to the harmony volume control 92. The potentiometer 246 is connected to the base of a PNP transistor 248 through series connected resistors 250 and 252 having values of 33K and 68K, respectively, and a variable resistor 254. The emitter of transistor 248 is connected to a +5 volt supply through a 10K resistor 256 and the collector is tied to negative −17 volts. Transistor 248 acts as a follower which supplies the negative DC keying level on line 218 to the common emitters of all of the transistors of transistor matrix 90 shown in FIG. 5.

It will be recalled from FIG. 3 that actuation of the rhythmic harmony switches causes modulation of the harmony notes, in the solo range. As seen in FIG. 6, the contacts of the harmony switch 94 are used to pass rhythmic pulse patterns over line 234 to the rhythmic harmony modulator 96. Three different pulse patterns, corresponding to the solo beats shown in FIG. 3, are present on lines 260, 262 and 264 from the rhythm circuit 36. The slide switches are interconnected so as to pass these rhythmic patterns to line 234, with switch III having priority over switch II which in turn has priority over switch I, in the event that multiple switches are actuated at the same time.

The rhythmic harmony modulator 96 is shown generally within the dashed lines in FIG. 6 and receives the pulse pattern coupled over line 234. This pulse pattern on line 234 is applied to the base of an NPN transistor 280 through a 220K resistor 282 and a capacitor 284. The emitter of transistor 280 is tied to capacitor 284 through one Megohm resistor 286. The collector of transistor 280 is connected to line 288 through a 3.3K resistor 290 and a capacitor 292 is connected between the transistor collector and emitter. The pulse pattern applied to the base of transistor 280 from rhythm generator 36 provides the forward bias for transistor 280 which then supplies its negative emitter potential in the form of pulses to line 288. These potential pulses on line 288 are applied to the base of the follower transistor 248 and through its emitter to line 218 connected to the common emitters of all of the transistors in transistor matrix 90 previously described with reference to FIG. 5.

Figure 7:
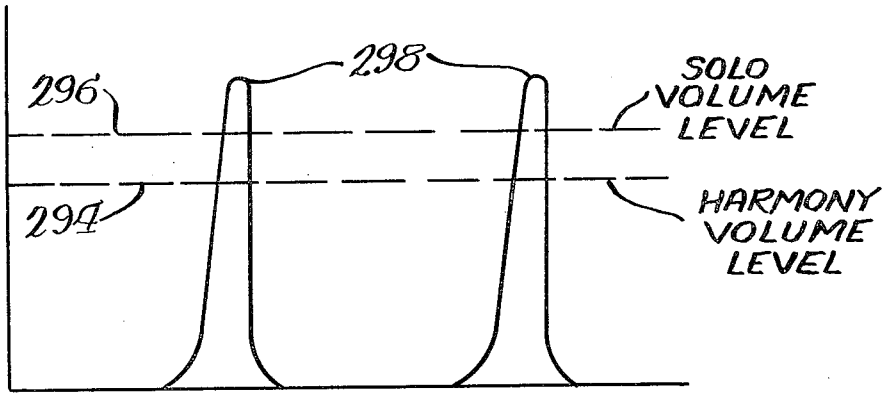
FIG. 7 illustrates voltage waveforms generated by the rhythmic harmony modulator shown in FIG. 6.

As can be seen from FIG. 7, the harmony volume level 294, as supplied on lead 218 by the circuit of FIG. 6, will always be equal to or less than the solo volume level 296, except for the short periods of time when the negative emitter potential pulses 298 from transistor 280, FIG. 6, are applied to the follower transistor 248. These short pulses 298 correspond to the modulated and time-spaced harmony notes 100 seen in FIG. 3. Furthermore, the volume of the modulated harmony notes exceeds the solo volume level of solo note 74, FIG. 3, for short time periods in order to produce a distinctive modulation pattern which the listener can hear over the level of the melody being played. Of course, when the rhythmic modulator is not activated, the harmony notes sound with a steady volume level 294 which is separate from the solo level 296, and is adjustable by potentiometer 246.

In FIG. 8, the arpeggio keyboard 38 and arpeggio buffers 46 are illustrated in detail. The arpeggio keyboard, or touch strip, 38 has twenty-two contacts 300 which are tied together by lines 302–313 to provide twelve switch inputs to the twelve input terminals 314–325 of the arpeggio tri-state buffers 46 in keyboard scan circuit 40. Each contact 300 when touched connects a ground terminal 330 to one of the twelve input terminals 314–325. A +5 volt supply is connected to the input terminals 314–325 through resistors 332, each having a value of 22K. Each tri-state buffer has six stages corresponding to the twelve keyswitch positions of the arpeggio keyboard.

Each of the two arpeggio buffers 46 are coupled to individual lines of the gating bus 48 which connect to the 1-of-10 decoder. Whenever an output pulse is placed on the corresponding one of the lines 48, its associated buffer 46 gates the keyswitch states received thereby onto six of the eight lines of the data bus 50.

As will be described later, the microprocessor continually reassigns different note names to the actuated keyswitch locations of the arpeggio keyboard. The twelve switch inputs 314–325 will be divided by the microprocessor into three groups of four switches, each group designating a different octave, and each keyswitch within a group being assigned to one of the note names of the keyswitches actuated on the accompaniment keyboard. For example, assuming that the notes C, E, and G are played on the accompaniment keyboard, the microprocessor will assign the notes $C_1$, $E_1$, and $G_1$ to the signals received from switch inputs 314, 315 and 316. The notes $C_2$, $E_2$ and $G_2$ will be assigned to the switch input signals from inputs 318, 319, and 320, and the notes $C_3E_3$ and $G_3$ will be assigned to the switch input signals from inputs 322, 323 and 324. The note subscripts 1, 2 and 3 designate the respective octaves in which the notes will be played. The fourth switch inputs in each group, switch inputs 317, 321, and 325, will not be assigned a note since only three notes were played on the accompaniment keyboard, and will produce no tone when actuated. The resulting gap appears between consecutive notes and between octaves. Thus, every time different notes are played on the accompaniment keyboard and the arpeggio strip keyboard 38 is played, the switch inputs 314–325 will be assigned new note designations by the microprocessor 54.

The arpeggio touch strip and associated circuitry shown in FIG. 8 is arranged to be capable of keying the designated notes in either an ascending or a descending arpeggio. When the organist runs his finger along the strip from left to center, the arpeggio notes will be sounded in ascending order. When the strip is played from the center to the right, the arpeggio notes will be sounded to descending order.

The RAM 56 of the microprocessor contains an input memory section or portion allocated to input data, shown in FIG. 9A, and an output memory section or portion for output data, as shown in FIG. 10. The memory map shown in FIG. 9A is in the form of a matrix which corresponds to an image of the input data from the buffers in the keyboard scan circuit 40, the status of the harmony switches 72, and information from the features module 34. This information is read into the memory map during the count signals, labelled 0–9 in FIG. 9B, of the output of the 1-of-10 decoder 70. The memory allocated to output, FIG. 10, consists of a map corresponding to the image of the transistor matrix 90. As will be explained later, the harmony generator and arpeggio-generator are responsive to the input data stored in the locations shown in FIG. 9A to manipulate and calculate new notes, using the direct access registers 58 of FIG. 1. As new harmony notes and arpeggio notes are determined, signals corresponding thereto are set into the output transistor map matrix of FIG. 10 in the appropriate locations corresponding to the newly determined notes to be generated on the solo keyboard.

The input portion of the memory, seen in FIG. 9A, will now be considered in more detail. When the decoder 70 produces its first decode count $\phi$, FIG. 9B, it actuates the first one of two accompaniment buffers 44 to cause it to place the status of its keyswitches onto the data buses 50 and 60 after which the microprocessor places the data into the first column, labelled ACCP, of the input memory, FIG. 9A. The second decode count, labelled 1 in FIG. 9B, then actuates the remaining accompaniment buffer 44 and causes the second column ACCP of the input matrix, FIG. 9A, to be filled. The two columns of accompaniment data, labelled ACCP, correspond to all note names actuated on the accompaniment keyboard, but contain no octave information. Thus, only twelve items of information are passed from the accompaniment buffers into the input memory or matrix.

During the decode counts labelled 2 through 7, as seen in FIG. 9B, the six solo buffers 42 are gated onto the data buses 50 and 60 and the information is stored in the next six columns, labelled solo, of the input matrix, FIG. 9A. The ten solo notes $C_7$ through D sharp $_6$ (D#$_6$) are connected together by a diode OR gate in the solo buffers, so that actuation of any of the corresponding keyswitches will be stored as D sharp 6, in location 330 of the memory map matrix of FIG. 9A. These ten notes are tied together because it has been found in practice that it is not necessary to determine specifically which of these notes were played in order to develop a musically acceptable harmony note.

Finally, the decode outputs 8 and 9 are generated in order to gate contents of the arpeggio buffers 46 into the two arpeggio storage columns, labelled ARP in FIG. 9A, which store the presence of any actuated arpeggio keyswitches. As will be explained in more detail, the microprocessor will assign note names to the arpeggio keyswitches, so the arpeggio columns in FIG. 9A merely store whether or not one of the individual keyswitches 300, shown in FIG. 8, has been actuated.

After the last output of the decoder 70 has been generated, microprocessor then places the EN$\phi$ signal over line 71. This enables the harmony switch 72 and features module 34, causing the last column, labelled EN$\phi$, of the input memory to store the 8 bits of information which are sent via the data buses 50 and 60 at this time. The first four bits of information are reserved for storage of the actuated position of any of the four harmony switches 72, due to the presence of actuated bits on the data bus lines $\phi$ through 3 shown in FIG. 14. The remaining four memory locations of the EN$\phi$ column correspond to the data bits 4 through 7 and come from the features module 34. Whenever the single finger chord is selected on the features module, for example, a data line of the memory bus 50 is actuated so as to allow the input matrix to store the fact that the feature module is operating in the single finger chord mode. Similarly, selection by the organist of a minor chord, a seventh chord, or a chord memory also result in actuation of lines so that this information is stored in the EN$\phi$ column of the input memory. It should be noted that the features module itself, which may be conventional, actually generates the single finger chord, which may be minor or seventh, and the chord memory feature, and that the features module may contain its own tone generators and keyers. However, the microprocessor 54 needs a record that these features have been selected so as to properly calculate the harmony notes based on the other information stored in the input memory, FIG. 9A.

The output memory or transistor matrix map, shown in FIG. 10, is the image of the transistor output matrix 90 and the notes shown, $C_6$ through $E_3$, are the newly determined harmony and arpeggio notes which can be generated. The transistor map matrix has been limited to the notes $C_6$ through $E_3$ because it has been found undesirable to generate new notes either above or below this range. It should be noted that the new notes shown in FIG. 10 do not have an upper frequency range as high as the input solo notes stored in the input matrix, FIG. 9A. This is because the harmony determinations, to be described, include rules that prevent a harmony note higher than C6 from being generated. It also should be noted that the lowest harmony note, E3, is three half-steps below the lowest solo note, G3, which can be produced on the solo keyboard. As will be explained, the highest harmony note generated will be at least a minor third, i.e., three half-steps, below the highest solo note. Additional harmony notes which would be lower in frequency are folded back to a higher octave, as was described in FIG. 2E.

FIG. 12 illustrates a generalized flow chart of the computer program, stored in the ROM 62, which controls the generation of new notes, which herein correspond to harmony and arpeggio notes. However, the microprocessor controlled note generator is capable of generating new notes for any desired reason. When power is turned on, the system is reset and memories are cleared or set to predetermined states by an initialize block 348. Then, the cycle is started and control is passed to a scan routine or subprogram 350 which causes the information in the keyboards and other tab switches to be read in to the input memory matrix, FIG. 9A, and to set certain of the information into the various registers 58. During the scan subprogram, the 1-of-10 decoder will have been stepped through the 10 outputs and the EN$\phi$ signal will have been placed over line 71 to input the data in the manner previously described.

A decision block 352 applies a set of logical rules to determine whether there has been a change in the scanned data that should be recognized for the purpose of harmony and arpeggio generation. Not all changes will be recognized for this purpose. The block 352 will produce an affirmative output if there has been an increase in the number of keyswitches actuated, including when there has been an increase from no keyswitches actuated to one or more keyswitches actuated. In addition, an affirmative output is produced when any new keyswitch is actuated which was not previously depressed. Therefore, a mere release of keyswitches does not create an affirmative output. When there is no change, the negative branch returns to start the scan cycle over.

A change in data results in control passing to a process routine or subprogram 354 which produces the data which will be needed to determine harmony notes to be generated. Control then passes to a decision block 356 which determines whether arpeggio is to be generated due to actuation of one of the keyswitches in the arpeggio keyboard. If affirmative, control passes to an arpeggio block 358 which determines the arpeggio notes and their correspondence with the keyswitches on the arpeggio keyboard. The resulting arpeggio notes are set in the output memory matrix shown in FIG. 10.

A harmony decision block 360 determines whether harmony notes are to be generated based on the data produced by the process subprogram 354. If negative, control passes to an output block 362 which signals completion of a routine to be outputted, and thereby dumps the output transistor matrix map of FIG. 10 to cause the data stored therein to be serially transmitted to the serial to parallel converter 86 for coupling to the transistor matrix 90. This in turn causes actuation of the associated solo keyers so as to produce solo notes for each note location represented by an actuated bit in the transistor matrix map in the RAM. It should be noted that actuation of the output memory was an asynchronous operation controlled by completion of a new note finding routine, and was independent of the input scan operation.

When harmony is to be generated, a harmony subprogram 364 applies a set of harmony rules to determine the number, note name, and octave location of the harmony notes to be generated and sets corresponding bits into the transistor matrix map of FIG. 10. Thereafter, control passes to the same output block 362 to cause the contents of the output memory matrix to be dumped in order to generate notes corresponding to the actuated bits set therein. After dumping of the output matrix, control returns to the beginning of the cycle.

The subprograms shown in FIG. 12 are illustrated in more detail in the remaining FIGS. 13A–G which will now be described. However, it should be understood that the FIG. 12 representation is generalized in that certain operations occur in a somewhat interleaved manner as will be apparent in the remaining figures.

Figure 13B:
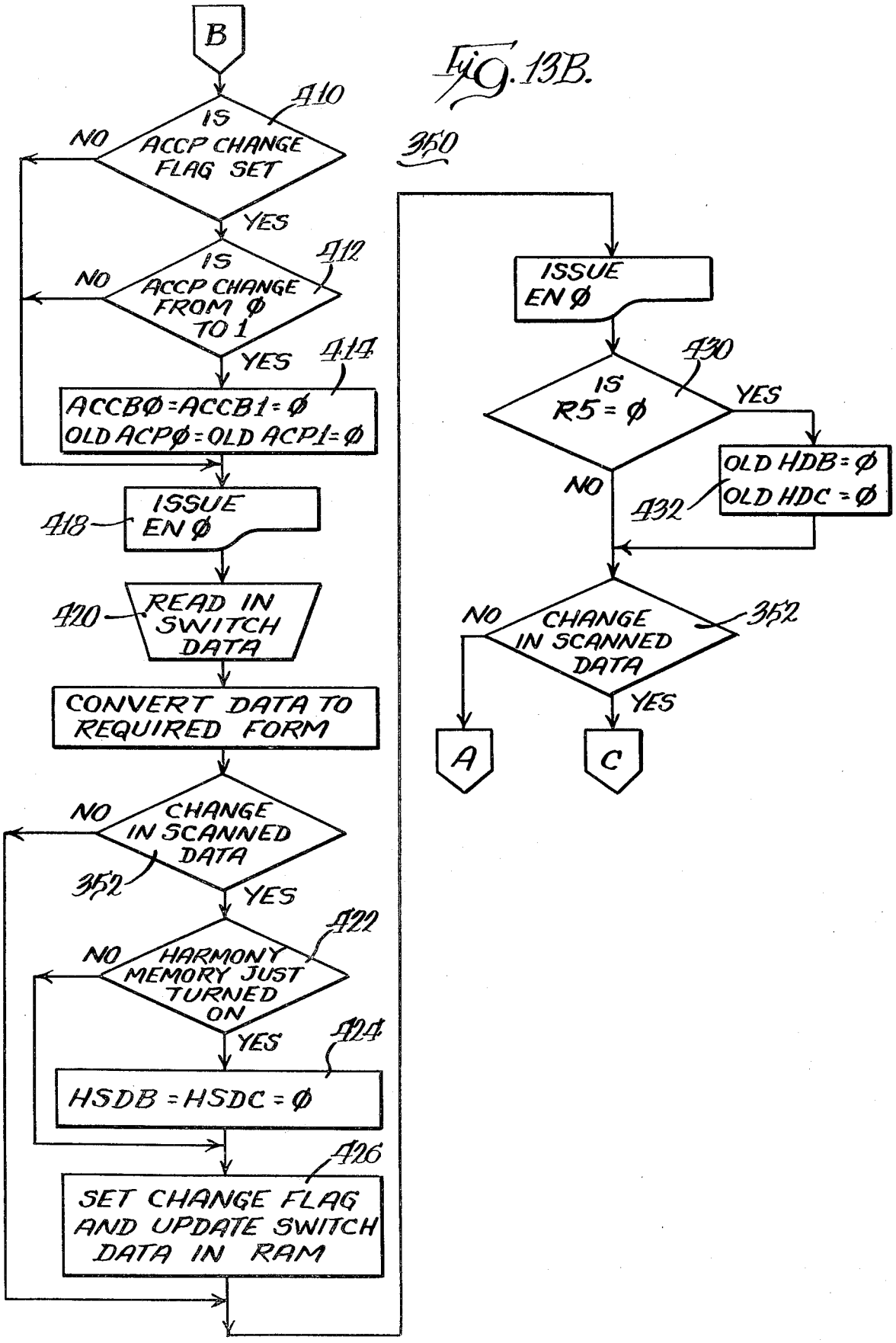

FIGS. 13A and 13B generally show the scan subprogram 350 in more detail. During the scan portion when data is read into the input matrix shown in FIG. 9A, certain information is set in the direct access registers 58. Eight registers, labelled Rϕ through R7, are utilized during this scan portion for storing certain information and manipulating the information to determine the highest harmony note which can be generated. Each register can store eight bits (one byte). Other working registers are utilized as will be described where appropriate. The use of the eight registers Rϕ–R7 during the initial portion of the control program cycle is as shown in the following TABLE II:

TABLE II

Initial register use during scan, process and initial harmony finding subprograms

| Register | Use |
|---|---|
| Rϕ | not used |
| R1 | pointer to RAM input memory (Fig. 9A) |
| R2 | temporary store of input data |
| R3 | decoder count down |
| R4 | decoder count up |
| R5 | highest solo note name and shift to determine highest harmony note name |
| R6 | highest solo note decoder count and shift to determine highest harmony decoder count |
| R7 | data change flags (ϕ = same data, 1 = change) |

A block 348, FIG. 13A, initializes the system and clears all of the registers R. As the cycle starts, a block 370 sets the contents of register R3 to 10 which represents the ten counts of the decoder 70 as illustrated in FIG. 9A. A block 372 then determines whether the arpeggio option has been selected and, if not, a block 374 resets the contents of register R3 to 8 so as to skip the last two counts 8 and 9 of the decoder which are only utilized, as seen in FIG. 9B, to read in information from the arpeggio buffers.

A register initialization block 375 now sets the contents of the registers R4 through R7 to zero and the contents of register R1 to the address to the first column or byte of the input memory of FIG. 9A.

A block 380 now outputs on bus 68, FIG. 1, a four bit binary word corresponding to the numerical count set in decoder register R4. Since the initial count is now ϕ, the 1-of-10 decoder actuates the zero line, see FIG. 9B, which actuates the first accompaniment buffer 44 to cause the contents thereof to be transmitted to the microprocessor. A block 382 then takes the data byte, which corresponds to the first column shown in FIG. 9A, and saves the contents thereof in the temporary register R2.

Since block 384 determines that we are on the first decoder count ϕ, control passes to the change data block 352 which, in response to a change in data, causes a block 386 to set a one bit in the first bit location in data change register R7. An update block 388 then causes the contents of the temporary register R2 to be stored into the first column or byte of the input memory, FIG. 9A.

Next, a block 390 causes the decoder count to increment by one and the pointer register R1 to increment by one so as to represent the next decoder count shown in FIG. 9B. Also, decoder register R3 is decremented by one and now will be equal to 9 or 7 depending on whether arpeggio options have been selected by blocks 372 and 374.

As long as the decision block 392 determines that we have not counted down to zero in the decoder register R3, control passes back to the start of the cycle in order to read in the next column or byte of information, shown in FIG. 9A, by actuation of the corresponding 1-of-10 decoder line of the bus 48.

After completing the reading in of the accompaniment buffers, the decoder register R4 will be on the third decoder count 2, which corresponds, as seen in FIG. 9A, to the first column of solo keyswitch information starting with the highest solo note. When a solo keyswitch is actuated, a 1 bit appears in the solo buffer corresponding to that location, with the lowest bit locations of the buffers storing higher solo notes. When control passes to the decision block 384, FIG. 13A, control will pass to a block 396 to determine whether the decoder register R4 has reached the count corresponding to the arpeggio keyswitches. This has not yet occurred, so the negative path is taken indicating that we are now reading in the solo notes corresponding to the decoder counts 2 through 7 as seen in FIG. 9A. This negative path leads to a block 398 which now looks at the contents of the temporary storage register R2 to determine if all zero bits are present. If not, a block 400 determines if this is the highest solo data byte or word (HSDB). The first actuation of block 400 corresponds to the highest solo note since this path is followed only when we are in the solo decoder count, and each increment to the decoder count is the next lower group of solo notes. If the temporary storage register R2 had all zero bits, control would have passed from block 398 to the change data block 352 after which the various registers would be incremented or decremented by block 390 to cause the decoder count to change and thus read in the next column of data.

The first time that the temporary storage register R2 contains a one bit for any solo note, block 400 in FIG. 13A passes control to a block 402 which sets the highest solo note name register R5 to the contents of the temporary storage register R2, and sets the contents of the highest solo note decode count register R6 to the contents of register R4, which now corresponds to the decode count in which a solo note was found. A change flag is set and the block 388 then updates the input memory, FIG. 9A, to correspond with the one bits in the data word then being read. Thus, at the completion of the solo decoder counts 2 through 7, register R5 will contain the column or byte of solo data, FIG. 9A, in which a one bit was set for the highest solo note, and the register R6 will contain the decoder count corresponding to that column or byte or data.

After completing all of the decoder outputs $\phi$ through 9, if the arpeggio option was present, or decorder outputs $\phi$ through 7, if arpeggio was not present, the decoder register R3 will have been decremented to zero. This time, block 392 passes control to a decision block 410, FIG. 13B. If the accompaniment ACCP flag had been changed by block 386, FIG. 13A, then block 410 passes control to block 412 which determines whether the change was from a $\phi$ to a 1, indicating that a new accompaniment keyswitch has been depressed. If affirmative, a block 414 initializes to zero two working accompaniment bits registers, labelled ACCB$\phi$ and ACCB1, and two working registers for old accompaniment bits, labelled Old ACP$\phi$ and Old ACP1. At this time, an output block 418 now issues the EN$\phi$ signal which is placed on line 71, FIG. 1, to activate the 4 bits of data from the harmony switches 72 and the 4 bits of data from the features module 34. A block 420 now reads in the resulting 8 bits of data and places the same in the temporary storage register R2.

A block 352, FIG. 13B, now determines whether any of the data read during the EN$\phi$ signal has changed by comparing the contents of the temporary register R2 with the contents stored in the input memory, FIG. 9A. If there has been a change, a block 422 then looks at the fourth bit location, corresponding to the counter melody tab, to determine whether it has been actuated, which indicates that the harmony memory should be turned on, as also seen in Table I. A block 424 then initializes a register for the highest solo note byte, HSDB, and the highest solo decode count, HSDC, after which a block 426 sets the change flag and passes the contents of the temporary storage register R2 to the last column of the input memory, FIG. 9A, so as to store the present harmony and feature module information.

A decision block 430 now determines whether the highest solo note name register R5 has all zeros, which if affirmative, indicates there is no harmony to be determined at this time and the block 435 initializes the old HDB and HDC for arpeggio purposes. A block 352 then determines whether there has been a change in scan data and, if not, control passes back to the start of the scan subroutine, FIG. 13A.

If there has been a change in the scan data, control now passes to the process subprogram 354 seen in FIGS. 13C and 13D in order to build up the data necessary for harmony finding. A block 440, FIG. 13C, clears all bits stored in the output transistor matrix map, FIG. 10. A portion of the arpeggio subprogram is now performed as a block 442 determines whether the arpeggio option has been selected, and a block 444 determines whether the arpeggio keyboard has been touched due to the presence of any one bits in the arpeggio columns 8 and 9 of the input memory, FIG. 9A. If any one "1" bit is present, a block 446 turns on the automatic sustain by outputting the binary signal over the bidirectional data bus 60, FIG. 1, which is passed by the bus driver 52 to actuate the sustain control 98. Thereafter, a block 448 clears the HSDB and HSDC working registers.

A decision block 450, FIG. 13C, now determines whether the highest solo note name register R5 has any one bit set therein. If the contents are zero, there still may be an effective highest solo note byte set in memory which is to be played if the harmony memory feature has been actuated. A block 452 determines whether an accompaniment byte has been memorized, and if affirmative, a block 454 determines whether the harmony memory feature is on due to actuation of the counter melody tab, see Table I. If affirmative, block 456 determines whether any accompaniment keyswitch is now down or has been placed in the past accompaniment keyswitch memory. If affirmative, a block 458 then sets the contents of the highest solo note name register R5 to the contents of the old highest data byte and the contents of the highest solo note decoder count register R6 to that contained in the old highest decode count working register. Control then passes to a decision block 462, FIG. 13D, which determines whether any keyswitch is now actuated on the accompaniment keyboard, while a block 464 determines whether an accompaniment byte is already stored in memory. If affirmative, a block 446 then determines whether either of these accompaniment bytes is an invalid or phony change due to a decreasing number of keyswitches or the release of a keyswitch, rather than the actuation of a new keyswitch. A valid accompaniment change then causes block 468 to set the working accompaniment byte registers ACCB$\phi$ and ACCB1 to the accompaniment data.

A block 470 now determines whether the single finger chord (SFC) mode was originally selected on the features module. This information is determined from the corresponding bit of the EN$\phi$ column of the input memory, FIG. 9A. If affirmative, a block 470 determines that only one key has been selected on the accompaniment keyboard, as is required for valid playing of the single finger chord mode. When affirmative, block 474 then determines whether more than one bit is stored in the two working accompaniment bit registers, which if true generates an error signal 476 which re-starts the system program.

Assuming no error, a block 480 then computes the two notes which the features module 34, FIG. 1, has already generated and coupled to the accompaniment keyers. It is necessary to determine this information in the microprocessor since the information in the accompaniment buffers indicates the actuation of only one keyswitch, and the microprocessor must utilize the three effective keyswitches which are being sounded to form the chord for the purposes of subsequent harmony finding. It should be understood that the computation block 480 is used for harmony finding, and that the actual sounding of the notes will have been generated conventionally by the features module 34. Block 480 uses the same rules utilized in conventional features modules to determine the pair of accompaniment notes which are to be sounded for the single note being played on the accompaniment keyboard, and places these notes into the working registers ACCB$\phi$ and ACCB1. At this point, the accompaniment bit registers are set with the notes either from the accompaniment keyswitches, the accompaniment notes and memory, or the accompaniment notes generated by the single finger chord mode.

Portions of the arpeggio subprogram are now performed beginning with a block 482, FIG. 13D, which passes control to block 484 to generate four arpeggio notes for each of three octaves. The four notes correspond to the same note names set into the accompaniment registers ACCB$\phi$ and ACCB1. Block 484 uses the same note names and places them into the transistor matrix map, FIG. 10, by setting the corresponding bits for the octaves 3, 4 and 5, as indicated in FIG. 10 by subscripts. A block 486 then reconfigures the highest solo note (HSN) data byte because the arpeggio has the same effect as solo finding.

A block 490 now determines whether the highest solo note HSN has been found. If not, harmony is not required at this time and control passes to the block 362 which now dumps out the contents of the transistor matrix map, FIG. 10, to the serial to parallel converter in order to output the current contents thereof.

If the highest solo note has been found, a block 492 determines whether it is in the range of the transistor matrix map and, if not, an error 494 is generated which restarts the program. If affirmative, a block 496 for self-checking determines whether the harmony switch has been actuated, and if not, block 362 causes the output of the transistor matrix map to be dumped. When the harmony switches are not on, only arpeggio data will be in the output memory and activated at this time. When the harmony switch is on, control passes to the harmony finding subprogram.

Figure 13E:
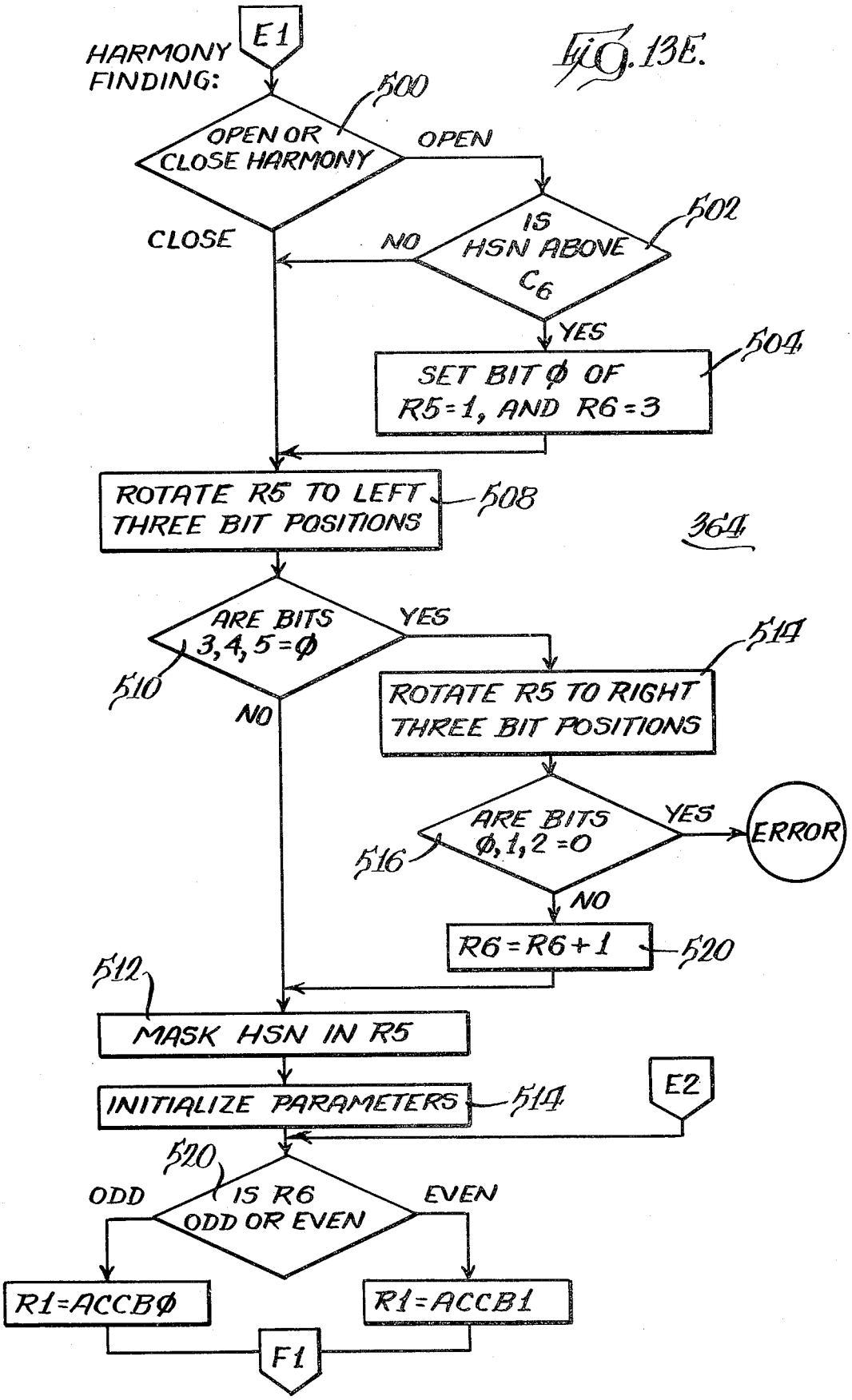

FIGS. 13E, 13F and 13G illustrate the harmony finding subprogram 364 which implements the harmony finding rules. A decision block 500 determines from the bits in the last column of the input memory whether open or closed harmony is to be played, based on the status combinations of the harmony switches using Table I. When open harmony is to be generated, a decision block 502 determines whether the highest solo note HSN is above note $C_6$, since it has been found that solo notes above $C_6$ are not needed for harmony finding and this operation reduces hardware requirements. If affirmative, a block 504 reconfigures the highest solo note to be equal to $C_6$ by setting bit $\phi$ of the highest solo note name register R5 to a one bit and by incrementing the highest solo note decoder count register R6 to three. As seen in FIG. 9A, the $\phi$ bit position, when set or actuated in the third column corresponds to note $C_6$.

The next operation, at block 512, insures that solo note name register R5 contains only the very highest solo note. Up to this point, the register R5 could have several bits set due to actuation of several sole keyswitches within the same column of the input memory matrix. Block 512 now masks the highest solo note in the register R5. This results in setting every bit in the shifted register R5 to $\phi$ except for the highest solo note bit.

A block 508 now begins to shift data from registers R5 and R6 so that the highest harmony note to be determined cannot be within a minor third, i.e., the first three halfsteps, from the highest solo note being played. This shift insures that the generated harmony notes will not be in discord with the highest solo note due to being too close in frequency. The operation of the shift will be explained with reference to FIGS. 11A–11D which show various operations performed on data from the highest solo note name register R5.

Block 508 rotates the data from register R5 to the left by three bit positions. For example, assume that register R5 has the contents shown in FIG. 11A at the time that the highest solo note decoder count register R6 has a count of five. As seen with reference to the input memory matrix, FIG. 9A, the actual note stored at this time corresponds to the note $C_5$. After block 508 has rotated the data to the left by three bit positions, the result is shown in FIG. 11B and, as seen with reference to FIG. 9A, this bit position corresponds to note $A_4$ (for the same decoder count of five).

A block 510, FIG. 13E, now determines if all of the bit positions 3, 4 and 5 in the rotated data are zero. As seen in FIG. 11B for the present example, the response is negative so control passes to a block 512 because the contents of the registers R5 and R6 now correspond to the highest harmony note which should be played.

As a second example, assume that the contents of the highest solo note name register R5 had been as seen in FIG. 11C when the highest solo note decoder count register R6 has the same count of 5. This corresponds to the note $G\#_4$ as can be seen with reference to FIG. 9A. When block 508 rotates this data to the left three bit positions, the result is as shown in FIG. 11D, since the 1st two bit positions of the 8 bit register are ignored. Decision block 510 now looks at the rotated data from register R5 to determine whether bit positions 3, 4 and 5 are zero.

As seen in FIG. 11D for the present example, the result is affirmative, so control now passes to a block 520, FIG. 13E, which adjusts the register R6 to account for what, in effect, is a shift in the column of FIG. 9A. In block 520 the contents of the highest solo note decoder count register R6 are incremented by one. Thus, the count will now be equal to six so that the resulting highest harmony note to be played will correspond to the bit position one and column six of the input memory matrix of FIG. 9A, corresponding to note $F_4$, which is three half-steps away from the starting position of note $G\#_4$.

A block 514 now initializes the parameters set in certain of the registers so that the direct access registers R, except for R5 and R6, now can be utilized for other purposes during the remaining portion of the harmony finding subprogram. The new use for these registers are indicated by the following Table III:

TABLE III

| Final register use during last portion of harmony finding subprogram | |
|---|---|
| Register | Use |
| R0 | pointer to output memory Fig. 10 |
| R1 | pointer to ACCB0 and ACCB1 registers |
| R2 | temporary store for matched results |
| R3 | total number of tries counted |
| R4 | not used |
| R5 | highest harmony note name |
| R6 | highest harmony note decoder count |
| R7 | harmony counter |

The block 514 sets the current contents of registers R$\phi$ and R2 to equal $\phi$, register R3 is set equal to 16, and register R7 is set equal to 1 or 2 depending on whether or not the harmony duet switch has been set as determined by the presence or absence of a bit in bit position 2 of the column EN$\phi$ in FIG. 9A.

Beginning at block 521, FIG. 13E, the rotated data from register R5 and the data from register R6, which data represent the very highest solo note shifted down by a minor third, are now shifted and then compared with the accompaniment notes recorded in the working accompaniment bit registers in order to find the actuated accompaniment note name closest to the adjusted highest solo note. This determines the first harmony note name. The shift is then repeated, followed by a comparison each time, in order to find the second harmony note name. As will be recalled, the first harmony note name may be placed in the first or second octave from the highest solo note depending on whether closed or open harmony was selected.

Block 521, FIG. 13E, determines whether the contents of the register R6, which now represents the adjusted highest solo decoder count, (which is the same as the possible highest harmony decoder count), is odd or even. The resulting determination then sets the contents of output pointer register R1 to the address of ACCB$\phi$ or ACCB1. This operation insures that the proper portion of the stored accompaniment information is used in the matching process that follows. A block 522, FIG. 13F, then fetches one accompaniment byte, either from ACCB$\phi$ or ACCB1, according to the pointer register R1. A block 524 then masks the content of that register by the possible highest harmony note name, i.e., looks at a single bit location in the working accompaniment byte register starting with the bit position indicated by the rotated data from register R5. Continuing with the example shown in FIG. 11A, it will be assumed that the highest harmony note byte has the configuration shown in FIG. 11B so that the first bit looked at, by a comparison finding or match block 526, corresponds to the bit position number three in the register R5. A match indicates that a harmony note has been found and control passes to FIG. 13G to determine the octave location of the found harmony note. When a match is not found, control passes to a block 528 which now shifts the searched for highest solo note bit down by one bit location, namely a shift to the left as illustrated in FIG. 11. Since increasing bit positions represent decreasing frequencies, as seen in FIG. 9A, the result is to search for the accompaniment note names in decreasing order on the musical scale.

A block 530, FIG. 13F, determines whether the down shift exceeded the byte length, and if not, a block 532 determines whether 16 bits have been tried as determined by the contents of register R3. Block 528 also increments the register R3 each time it shifts down.

The block 532 attempts 16 tries because there are 16 bits in the two working accompaniment registers ACCB$\phi$ and ACCB1, although only six bit positions in each register are valid, similar to FIG. 11. When both registers have not been tried, control passes back to the block 524 which now looks for a match based on the shifted bit location. When block 530 determines that the shift has been beyond the end of one byte, a block 534 sets bit $\phi$ of the shifted data from register R5 equal to 1 and increments the highest harmony decode counter register R6 by one, thus effectively shifting, as seen in FIG. 9A, to the beginning of the column of the next lower group of notes. This block also selects the data from the remaining accompaniment register, ACCB$\phi$ and ACCB1, that was not previously selected by block 521.

A second match decision block 536 then determines whether the present bit being searched produces a match and, if affirmative, passes control to FIG. 13G. When no match is present, control passes to a block 538 which determines whether 16 bits have been tried, and if negative, a block 540 determines whether enough harmony notes, namely two, have been found. This is determined by the contents of the harmony counter register R7. If negative, a block 542 again shifts down the highest solo note bit and control passes to the block 521, FIG. 13E, to continue the same process of finding the harmony note names.

Although the program attempts to match at least 16 bits of the accompaniment data, only 12 bits represent real notes, with the last two bit positions 6 and 7 of each accompaniment byte representing phony notes. Since 12 bits represent a complete octave, any note names initially skipped because they were within a minor third will be returned to at the end of the harmony finding comparisons, but such notes, if they produce a comparison, are given the lowest ranking, i.e., are considered the furthest away from the highest solo note.

Each time a match is found, the contents are stored in the temporary storage register R2, and control passes to FIG. 13G to determine the octave in which the found harmony note name or names will be played. A block 550 determines whether open or closed harmony has been selected, as determined by the harmony switch status based on Table I. Close harmony means that the first found harmony note will remain in the octave immediately below the highest solo note, so control passes to a block 552. If block 550 determines that open harmony is selected, a block 554 then determines whether we are looking at the first or second harmony note. Since the second harmony note is not shifted down an octave, but remains in the octave immediately below the highest solo note (meaning within 12 notes from the highest solo note), the presence of the second harmony note again causes control to pass to block 552.

When looking for the first harmony note in open harmony, a block 560 sets a flag FGFM which designates the first harmony note. It then shifts the pointer register R$\phi$ down one octave by shifting two columns to the right. As seen in FIG. 10, for the same bit position, a shift of two columns results in a decrease of one octave. The PH represents the phony RAM location, corresponding to a given bit location, which is shifted from its present column location, as represented by the decoder count in register R6, to an additional two columns away.

A routine 562, FIG. 13G, then determines whether the output memory pointer register Rϕ can result in a harmony note within the range of the organ or a desired range for pleasant harmony. A decision block 564 first determines whether the register Rϕ points to a location within the range of the transistor matrix map of FIG. 10. If affirmative, a block 566 then sets the result in the output memory or transistor matrix map, FIG. 10, so as to output that harmony note when the transistor matrix map is dumped.

If decision block 564 had determined that the output memory pointer register Rϕ was not within the transistor map range, control would pass to a block 566 to determine whether the pointer was within one octave of the transistor map. This implements a harmony rule which has been found to be desirable, namely, an automatic fold back of a harmony note should occur only if the new note would have been within one octave from the bottom of the solo keyboard. When affirmative, a block 568 decrements two columns from the pointer so as to bring the harmony note within the range of the organ. This results in a fold back of the generated harmony note into a higher octave, as previously explained in FIG. 2E with reference to the dashed lines.

If the pointer register Rϕ is more than one-octave away from the transistor matrix map, block 566 would have passed control to the block 570 which would count the result as a harmony note, but would bypass block 566 which sets the result into the transistor matrix map. Thus, this harmony note would not sound because it is out of the range of the organ, but it would be counted as a harmony note so as to not produce a false result in the harmony determining process. Without this operation, an additional harmony note would be generated which would not have the proper relationship and thus could sound discordant.

When closed harmony is being determined, either due to the first harmony note in closed harmony, or the second harmony note, block 552 determines whether the decoder count register R6 is equal to or greater than a column count of 9 which, as seen in FIG. 10, is outside the range of the transistor matrix. If affirmative, control passes to block 570 which counts the result as harmony but does not result in any sounding of a harmony note.

Control then passes to block 580 which determines whether the contents of the decoder count register R6 is a column count of two, which as seen in FIG. 10, is also outside the range of the transistor matrix. If affirmative, a block 582 sets the contents of register R6 to three so as to sound the harmony note in the third column of FIG. 10 (with respect to the decoder counts shown in FIG. 9B). If the contents of register R6 are other than two, the register is not disturbed as the number stored therein represents the column for the harmony note.

A block 584 then increments the pointer counter register by the contents of the decoder count register R6 after which a block 586 causes the results to be set in the transistor matrix map.

If more than one harmony note is called for, as determined by Table I, a block 590 will then loop back to determine the information needed for the second match. Otherwise, control passes to block 362 which signals a completion and dumps the result of the output memory or transistor matrix map. This results in a sounding of the harmony notes and arpeggio notes in the solo voice of the organ.

As previously noted, the enabling of the output memory, FIG. 10, depends on when completion occurs of one of the harmony and/or arpeggio finding operations, and thus is not synchronized to the keyboard scan operation. It will also be appreciated from the foregoing description that harmony computations are not carried out each time the keyboard is scanned, but rather that such computations are initiated whenever a scan cycle detects in a change in keyboard data that is recognized as valid for the purposes of harmony determination.

The embodiment of the invention described above is merely illustrative of the broad inventive concepts comprehended by the invention.

We claim:

1. An electronic musical instrument for automatically generating notes related to other notes selected by an individual playing the instrument, comprising:

keyboard means having a plurality of keys corresponding to notes of the musical scale with at least a portion corresponding to solo notes and a portion corresponding to accompaniment notes;

voicing means for sounding solo notes;

harmony switch means for selecting a plurality of harmony modes including at least one harmony mode for producing a single harmony note and at least one harmony mode for producing plural harmony notes for identical actuations of the keyboard means;

processing means responsive to said keyboard means and said harmony switch means for generating at least one harmony note having a frequency interval displaceable with respect to the highest solo note in accordance with the mode selected on the harmony switch means; the harmony note sounding with said solo voicing.

2. The electronic musical instrument of claim 1 wherein the processing means includes harmony finding means for determining at least two harmony notes when at least two accompaniment notes are played on the keyboard means, and selection means controlled by the harmony switch means for selecting only a single harmony note based on the at least two accompaniment notes.

3. The electronic musical instrument of claim 2 wherein the processing means further includes octave determining means for displacing the single harmony note between the octave immediately below the highest solo note and the second octave immediately below the highest solo note in accordance with the mode selected on the harmony switch means.

4. The electronic musical instrument of claim 1 wherein the processing means includes harmony finding means for determining a plurality of harmony notes based on a plurality of accompaniment notes actuated on the keyboard means, the processing means being effective to generate at least one of the harmony notes in the octave immediately below the highest solo note; and octave displacement means for displacing the remaining harmony note between the octave immediately below the highest solo note and the second octave immediately below the highest solo note in accordance with the mode selected on the harmony switch means.

5. The electronic musical instrument of claim 1 wherein the processing means includes harmony finding means for determining a plurality of harmony notes based on a plurality of accompaniment notes actuated on the keyboard means, the processing means being effective to generate at least one of the harmony notes in the octave immediately below the highest solo note; and octave displacement means for displacing one of the harmony notes into a different octave without displacing the remaining harmony notes generated by the instrument.

6. The electronic musical instrument of claim 1 wherein the processing means includes harmony finding means for generating the at least one harmony note based on the note names of the accompaniment notes actuated on the keyboard means, and harmony memory means actuable by the harmony switch means for maintaining the sounding of the at least one harmony note after actuation of the accompaniment keyboard portion is terminated so as to maintain the harmony.

7. An electronic musical instrument for automatically generating notes related to other notes selected by an individual playing the instrument, comprising:

solo keyboard means having a plurality of solo keys corresponding to solo notes, accompaniment keyboard means having a plurality of accompaniment keys corresponding to accompaniment notes, solo finding means for determining the highest solo note actuated on the solo keys, and harmony finding means capable of determining at least two harmony notes when at least two accompaniment keys are actuated, including harmony selection means for selecting only a single one of the at least two harmony notes for sounding in a predetermined octave with respect to the highest solo note.

8. The electronic musical instrument of claim 7 wherein the harmony selection means selects the note name of the actuated accompaniment note which is closest to the note name of the highest solo note.

9. The electronic musical instrument of claim 8 wherein the harmony selection means includes means for preventing selection of a note name which is within a predetermined note interval from the highest solo note.

10. The electronic musical instrument of claim 9 wherein the predetermined note interval comprises three half-steps away from the highest solo note.

11. The electronic musical instrument of claim 7 wherein the harmony selection means includes octave displacement means for sounding the single harmony note in the first octave adjacent the highest solo note or in the second octave adjacent the highest solo note.

12. The electronic musical instrument of claim 7 wherein the harmony finding means includes harmony fold back means for automatically increasing the octave of the single harmony note when the harmony finding means would otherwise sound the harmony note below a first predetermined location associated with the solo keyboard means.

13. The electronic musical instrument of claim 12 including disable means for disabling the harmony fold back means when the harmony finding means would otherwise sound the harmony note below a second predetermined location lower in frequency than the first predetermined location.

14. The electronic musical instrument of claim 7 including solo keyer and voicing means for sounding solo notes corresponding to actuated solo keys, solo volume control means for adjusting the volume of actuated solo notes produced by the solo keyer and voicing means, coupling means for coupling the harmony notes to the solo keyer and voicing means to produce harmony notes with a solo voice, and harmony volume control means for controlling the volume of the harmony notes separately from the volume of the solo notes.

15. An electronic musical instrument for automatically generating notes related to other notes selected by an individual playing the instrument, comprising:

solo keyboard means having a plurality of solo keys corresponding to solo notes, accompaniment keyboard means having a plurality of accompaniment keys corresponding to accompaniment notes, harmony finding means for determining at least two harmony note names when at least two accompaniment keys are actuated, solo finding means for determining the highest solo note actuated on the solo keys, and harmony control means for sounding one of the two harmony note names in the first octave below the highest solo note and the other of the two harmony note names in a different octave below the highest solo note.

16. The electronic musical instrument of claim 15 wherein the harmony finding means determines the closest note name to the highest solo note, and the harmony control means is effective to sound the closest note name in the different octave rather than the first octave below the highest solo note.

17. The electronic musical instrument of claim 15 wherein the harmony control means includes fold back means responsive when any harmony note falls below a predetermined location on the keyboard means for automatically displacing the harmony note to the first octave below the highest solo note.

18. The electronic musical instrument of claim 16 wherein the harmony finding means includes means for skipping a harmony note name which is within a predetermined number of half-steps away from the highest solo note and selecting instead the next harmony note name closest to the highest solo note.

19. An electronic musical instrument for automatically generating notes related to other notes selected by an individual playing the instrument, comprising:

solo keyboard means having a plurality of solo keys corresponding to solo notes in different octaves;

accompaniment keyboard means having a plurality of accompaniment keys corresponding to accompaniment notes in different octaves;

input means for generating solo signals representing the note name and octave for actuated solo keys and accompaniment signals representing only the note name, irrespective of octave for actuated accompaniment keys;

solo finding means responsive to the solo signals for determining the highest solo note actuated on the solo keys;

harmony switch means for selecting a plurality of harmony modes to produce different harmony notes for identical actuations of the keyboard means, each of said modes defining the number of harmony notes to be generated and an octave relationship for each harmony note to be generated with respect to the highest solo note; and harmony finding means for generating a plurality of harmony notes having the same note names as the accompaniment signals and sounded in the octave relationship with respect to the highest solo note as defined by the selected harmony mode.

20. The electronic musical instrument of claim 19 wherein the input means comprises solo gating means coupled to the solo keyboard means for generating a separate solo signal for each solo key, accompaniment gating means for generating twelve accompaniment signals representing only the note names of the actuated accompaniment keys, and scan means for coupling the solo and accompaniment gating means to the finding means.

21. The electronic musical instrument of claim 20 including memory means having a solo section for storing the solo signals and an accompaniment section for storing the accompaniment signals, the scan means being repeatedly actuated to repeatedly fill the memory means, the finding means being responsive to the signals stored in the memory means.

22. The electronic musical instrument of claim 19 wherein the harmony finding means includes a note finding means for searching the accompaniment signals for the next note name closest to the note name of the highest solo note, and count means responsive to the harmony switch means for repeatedly actuating the note finding means until the number of note names, defined by the selected harmony mode have been found from the accompaniment signals.

23. The electronic musical instrument of claim 22 wherein the harmony finding means includes octave determining means for sounding one of the harmony notes in the first octave immediately below the highest solo note and another of the harmony notes in the second octave immediately below the highest solo note.

24. The electronic musical instrument of claim 19 wherein the solo finding means includes register means containing a plurality of bit positions corresponding to the note name and octave signals, means for setting into the register means the highest solo note, means for shifting the signals in the register means to provide a new note displaced from the highest solo note, and the harmony finding means eliminating note names of the accompaniment signals which correspond to note names between the highest solo note and the new note.

25. An electronic musical instrument for automatically generating notes related to other notes selected by an individual playing the instrument, comprising:

solo keyboard means having a plurality of solo keys corresponding to solo notes, solo keyer and voicing means for sounding solo notes corresponding to actuated solo keys, accompaniment keyboard means having a plurality of accompaniment keys corresponding to accompaniment notes, accompaniment keyer and voicing means for sounding accompaniment notes corresponding to actuated accompaniment keys, harmony generating means for generating harmony notes spaced from a solo note actuated on the solo keys and related to the accompaniment notes actuated on the accompaniment keys, and harmony control means for coupling the harmony generating means to the solo keyer and voicing means to sound both the solo notes and the harmony notes with the solo voice, including adjustment means for establishing the output level of the harmony notes separate from the output level of the solo notes sounded on the solo keyer and voicing means.

26. The electronic musical instrument of claim 25 including solo volume control means for adjusting the volume of the solo notes produced by the solo keyer and voicing means, the adjustment means being coupled to the solo volume control for establishing a harmony volume level for the harmony notes which may be different than the level of the solo volume level.

27. The electronic musical instrument of claim 26 wherein the adjustment means includes a harmony volume control adjustable by the individual playing the instrument, and a level adjustment circuit coupled to the harmony volume control and the solo volume control for reducing the harmony volume level of the harmony notes by a predetermined amount less than the solo volume level established by the solo volume control.

28. The electronic musical instrument of claim 27 including a harmony modulator for periodically increasing the level of the harmony volume notes above the solo volume level to product harmony notes with increased emphasis over the solo notes.

29. The electronic musical instrument of claim 25 wherein the harmony control means includes a harmony modulator for modulating the harmony notes in a rhythmic pattern to produce a plurality of beats rhythmically spaced from the solo note utilized by the harmony generating means.

30. The electronic musical instrument of claim 29 including a rhythm means having a plurality of outputs carrying different pulse patterns corresponding to different rhythmic beats, rhythmic harmony switch means having a plurality of modes for selecting different outputs of the rhythm means for coupling to the harmony modulator in order to produce different beats of the harmony notes.

31. An electronic musical instrument for automatically generating notes related to other notes selected by an individual playing the instrument, comprising:

solo keyboard means having a plurality of solo keys corresponding to solo notes in different octaves;

accompaniment keyboard means having a plurality of accompaniment keys corresponding to accompaniment notes in different octaves;

input memory means for storing note representations of actuated solo keys and accompaniment keys, said memory means having a plurality of individual solo storage locations each corresponding to a different solo key and a plurality of individual accompaniment note storage locations each corresponding to accompaniment keys having the same note name;

scanning means for repeatedly actuating the individual storage locations of the input memory means to store the note representations of the corresponding solo keys and accompaniment keys when said keys are actuated to form an image of the keys in the input memory means;

processing means responsive to the input memory means for generating new notes determined by the notes represented by actuated individual storage locations; and keyer and voicing means for sounding the notes corresponding to actuated keys of the solo keyboard means and corresponding to the new notes from the processing means.

32. An electronic musical instrument of claim 31 including output memory means for storing new notes generated by the processing means having a plurality of individual storage locations each corresponding to a different one of the new notes, the keyer and voicing means being responsive to the individual storage locations in the output memory means for converting the new notes into sounds.

33. The electronic musical instrument of claim 32 including gating means operating independently of the scanning means for repeatedly gating the individual storage locations of the output memory means to the keyer and voicing means, whereby the operation of the gating means is asynchronous with respect to the scanning means.

34. The electronic musical instrument of claim 32 wherein the processing means includes a plurality of note finding means each of which is responsive to the input memory means to determine different new notes and to signal completion of its note finding operation, the gating means being responsive to each completion signal to gate the output memory means to the keyer and voicing means.

35. The electronic musical instrument of claim 31 including a plurality of solo gate means each coupled to different groups of the plurality of solo keys and a plurality of accompaniment gate means each coupled to a different group of accompaniment keys and scan means for individually gating each of the plurality of solo and accompaniment gate means to the input memory means.

36. The electronic musical instrument of claim 35 wherein the input memory means comprises a matrix of individual storage locations consisting of groups of solo storage locations and groups of accompaniment storage locations, and the scan means operates to gate note representations for each group of keys into a corresponding group of individual storage locations in the matrix.

37. The electronic musical instrument of claim 35 including address means for generating different addresses, and decoder means responsive to the different addresses to actuate individual ones of the plurality of solo and accompaniment gate means in order to transfer the status of the solo and accompaniment keyboard means to the input memory means.

38. The electronic musical instrument of claim 31 including old note storage means for storing past actuated keys of the keyboard means, and the processing means is responsive to the input memory means and the old note storage means for generating the new notes.

39. The electronic musical instrument of claim 31 wherein the processing means is responsive to the portion of the input memory means which stores solo notes for determining the highest solo note actuated on the keyboard means, and the processing means includes harmony finding means for generating a harmony note having the same note name as contained in the portion of the input memory means storing the accompaniment notes and an octave determined relative to the highest solo note.

40. The electronic musical instrument of claim 31 further including solo buffer means coupled to the solo keys for gating the solo note name and octave of each actuated solo key, accompaniment buffer means coupled to the accompaniment keyboard means for gating only the note names of the actuated accompaniment keys irrespective of the octave thereof, the scanning means repeatedly actuating the buffer means to pass to the input memory the solo note name and octave and the accompaniment note name only.

41. An electronic musical instrument for automatically generating notes related to other notes selected by an individual playing the instrument, comprising:

solo keyboard means having a plurality of solo keys corresponding to solo notes, accompaniment keyboard means having a plurality of accompaniment keys corresponding to accompaniment notes, memory means for storing note representations of the actuated solo keys and accompaniment keys, processing means responsive to the memory means for determining new notes different from the note representations stored in the memory means, storage means for storing the new note determinations from the processing means, and keyer means for sounding notes corresponding to the actuated solo keys and accompaniment keys and for sounding the new notes stored in the storage means.

42. The electronic musical instrument of claim 41 including input gating means for repeatedly causing the note representations to be stored in the memory means, and output gating means for repeatedly causing the new note determinations from the storage means to be coupled to the keyer means independent of the repetition rate of the input gating means whereby the output gating means operates asynchronously with respect to the input gating means.

43. The electronic musical instrument of claim 42 wherein the processing means includes a plurality of different note determining controls each responsive to the same note representations stored in the memory means to produce different new note determinations and to signal completion of the note determining operation, switch means actuable by the individual playing the instrument to select different modes of harmony note determination, the switch means enabling one or more of the plurality of controls and the output gating means being actuated by the completion signal.

44. The electronic musical instrument of claim 41 including register means for temporary storage, and the processing means stores note representations in the register means during the note determining operation.

45. The electronic musical instrument of claim 44 wherein the processing means includes means for determining and storing in the register means the highest solo note of the solo note representations in the memory means, note name means for determining at least one accompaniment note name in the memory means, and harmony finding means responsive to the register means and the note name means for generating a harmony note having the same note name as in the note name means and located a predetermined note interval with respect to the contents of the register means.

46. The electronic musical instrument of claim 41 wherein the keyer means includes solo keyer and voicing means coupled to the solo keyboard means for sounding solo notes actuated on the solo keys and accompaniment keyer and voicing means coupled to the accompaniment keyboard means for sounding accompaniment notes actuated on the accompaniment keys and further including an OR gating means for coupling the storage means to at least one of the keyer means to sound the new notes determined by the processing means.

47. The electronic musical instrument of claim 46 including a keyer volume control associated with the keyer and voicing means coupled to the OR gating means to adjust the sound level of the notes sounded due to actuation of the keys of the associated keyboard means, and new note volume control means for adjusting the sound level of the new notes produced by the same keyer and voicing means separately from the keyer volume control.

48. The electronic musical instrument of claim 41 including switch means for selecting a plurality of harmony modes, and the processing means includes octave determining means for displacing the new notes between different octaves in accordance with the mode selected on the switch means.

49. The electronic musical instrument of claim 41 including gating means coupled to the storage means, a serial to parallel converter having a serial input coupled to the gating means for receiving serial data representing the new note determinations stored in the storage means and having a plurality of parallel outputs, and a storage matrix having a plurality of individual storage locations each corresponding to different notes and coupled to the keyer means for sounding the corresponding notes when the individual storage locations are set, the individual storage locations each being coupled to an individual one of the parallel outputs of said converter.

50. An electronic musical instrument for automatically generating notes related to other notes selected by an individual playing the instrument, comprising:

first keyboard means having a plurality of keyswitches representing different note names, second keyboard means having a plurality of keyswitches each of which is not assigned any note name, note computation means for identifying a group of note names corresponding to actuated keys of the first keyboard means, assignment means for allocating each note name from the note computation means to different keyswitches of the second keyboard means, and processing means for sounding the allocated note names as the corresponding keyswitches of the second keyboard means are actuated by the individual playing the instrument.

51. The electronic musical instrument of claim 50 wherein the assignment means jumps certain keyswitches of the second keyboard means to create no sounds when the corresponding keyswitches are actuated.

52. The electronic musical instrument of claim 51 wherein the assignment means allocates all of the note names from the note computation means to different groups of keyswitches of the second keyboard means with each adjacent group having an increasing or decreasing octave in order to create an ascending or descending arpeggio effect as the keyswitches are sequentially actuated by the individual playing the instrument.

53. The electronic musical instrument of claim 50 including note finding means for generating a new note different than the actuated keyswitches of the first keyboard means, and keyer and voicing means for sounding the new notes from the note finding means and the allocated note names from the processing means.

54. The electronic musical instrument of claim 53 including a third keyboard means having a plurality of solo keys corresponding to solo notes, the note finding means generates at least one harmony note having the same note name as an actuated key of the first keyboard means and located in a predetermined octave with respect to the highest solo note actuated on the solo keys.

55. The electronic musical instrument of claim 50 including sustain means actuable to sustain the sounding of the allocated note names for a short time interval after deactuation of the keyswitches of the second keyboard means, and means for automatically actuating the sustain means when any of the plurality of keyswitches of the second keyboard means has been actuated.

* * * * *